US012710213B2

(12) United States Patent
Park et al.

(10) Patent No.: US 12,710,213 B2
(45) Date of Patent: Aug. 18, 2026

(54) REFRIGERATOR

(71) Applicant: LG ELECTRONICS INC., Seoul (KR)

(72) Inventors: Hyunjin Park, Seoul (KR); Jeongho Ban, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 254 days.

(21) Appl. No.: 18/385,634

(22) Filed: Oct. 31, 2023

(65) Prior Publication Data

US 2024/0142157 A1 May 2, 2024

(30) Foreign Application Priority Data

Nov. 1, 2022 (KR) ..... 10-2022-0143839
Nov. 1, 2022 (KR) ..... 10-2022-0143840

(51) Int. Cl.
*F25D 17/06* (2006.01)
*F25B 13/00* (2006.01)

(52) U.S. Cl.
CPC ..... *F25D 17/062* (2013.01); *F25B 13/00* (2013.01)

(58) Field of Classification Search
CPC . F25D 17/062; F25D 2323/0022; F25B 13/00
See application file for complete search history.

(56) References Cited

U.S. PATENT DOCUMENTS

2008/0223063 A1* 9/2008 Jeong ..... F25D 23/003 62/291
2011/0113817 A1* 5/2011 Kofele ..... F25D 23/006 62/455
2012/0118000 A1 5/2012 Chae et al.
2021/0025641 A1* 1/2021 Thomas ..... F25D 19/04
2022/0087446 A1 3/2022 Friend et al.

FOREIGN PATENT DOCUMENTS

JP 2005-121341 A 5/2005
JP 2012-255601 A 12/2012
KR 10-2011-0019074 A 2/2011
KR 10-2406029 B1 6/2022

* cited by examiner

*Primary Examiner* — Elizabeth J Martin
(74) *Attorney, Agent, or Firm* — Birch, Stewart, Kolasch & Birch, LLP

(57) ABSTRACT

A refrigerator includes a storage compartment and a machine room including a first machine room and a second machine room which are disposed side by side in a left-right direction. Air introduced into the first machine room may be discharged outside through a first circulation path, and air introduced into the second machine room may be discharged outside through a second circulation path. The first circulation path and the second circulation path may have circulation directions that are opposite to each other.

16 Claims, 17 Drawing Sheets

REFRIGERATOR

CROSS-REFERENCE TO RELATED APPLICATION

This application claims priority to and the benefit of Korean Patent Application No. 10-2022-0143839, filed on Nov. 1, 2022, and Korean Patent Application No. 10-2022-0143840, filed on Nov. 1, 2022, the disclosures of which are incorporated herein by reference in their entireties.

BACKGROUND

Field

The present disclosure relates to a refrigerator, more particularly, a refrigerator that may dissipate heat from a machine room, with an efficient cooling system, and that includes a guide fan fixing a condenser and a blower fan module, with an air flow path guide shape.

Description of Related Art

A refrigerator is an electric home appliance configured to supply cold air generated through heat exchange with a refrigerant circulating in a cooling cycle to a storage compartment to keep various types of storage targets fresh for a long period of time.

Specifically, the cold air supplied to the storage compartment may be generated by taking away heat from the refrigerator, as the refrigerant circulating in the order of a compressor, a condenser, an expansion valve, an evaporator and a compressor flows into the evaporator and the liquid refrigerant is vaporized into a gaseous refrigerant.

The compressor may pressurize and heat up the low-temperature-and-low-pressure gas refrigerant introduced from the evaporator into a high-temperature-and-high-pressure gas refrigerant and send it to the condenser.

The condenser condenses the refrigerant introduced from the compressor by external air and the refrigerant introduced from the condenser is pressure-reduced and expanded, while passing through the expansion valve having a relatively narrow diameter.

The refrigerant having passed through the expansion valve may flow into the evaporator and evaporate at a low pressure, thereby absorbing heat inside the storage compartment and supplying cold air to the storage compartment.

Among the components constituting the cooling cycle, the compressor and the condenser may be disposed in a machine room divided from the storage compartment as a separate space.

In the process of driving the cooling cycle, much heat could be generated in the machine room, so a blower fan module for sucking external air may be disposed in the machine room to cool the inside of the machine room.

The blower fan module may draw external air into the machine rooms so that components inside the machine room such as the condenser, the compressor and etc. may be cooled through an air circulation method.

The temperature of the external air having passed through the condenser and the compressor after drawn into the machine room may relatively increase, and the external air having the increased temperature may be discharged to the outside of the machine room.

In this way, the cooling system for dissipating heat from the machine room through the air circulation cycle for inlet and outlet of external air may be realized inside the machine room.

Recently, demands for a large-sized refrigerator having an increased internal volume of a storage compartment are increasing.

As a refrigerator become larger, a plurality of compressors and condensers may be installed to provide separate cooling cycles to a refrigerator compartment and a freezer compartment, respectively.

However, when the refrigerator becomes larger, the area of the machine room might also increase and heat generated from the plurality of compressors and condensers installed in the large machine room space and heat generated from the air circulation cycle might be mixed in the machine room.

When the heats generated in various ways are mixed in the machine room, there might be a problem in that an air circulation rate and a flow rate decrease, thereby reducing heat dissipation performance and efficiency.

If the heat dissipation performance and efficiency is reduced, air circulation performance might be very inefficiency such as difficulty in controlling the temperature of the storage compartment in a harsh environment like high temperature.

In this case, if the size or rotation number of the blower fan module is increased in order to improve the heat dissipation performance and efficiency, noise might be increased and power consumption might be increased.

The deterioration in heat dissipation performance for the compressor and the condenser might deteriorate the efficiency of driving components in the machine room, which eventually leading to a decrease in cooling capacity and efficiency of the refrigerator.

Meanwhile, when the external air drawn through the inlet of the machine room is circulated and discharged from the outlet of the machine room, the air discharged through the outlet adjacent to the inlet may be immediately re-drawn into the inlet as soon as it is discharged.

The air discharged through the outlet already has the increased temperature, compared to external air. So, when the air discharged through the outlet is immediately re-drawn into the inlet, external air with a relatively low temperature could not be drawn and heat dissipation performance could be reduced accordingly.

Especially, as the refrigerator becomes larger, the width of the mechanical chamber increases. In this instance, the area of the outlet could increase compared to the inlet of external air only to reduce the heat dissipation performance more.

In addition, in order to enhance the heat dissipation effect of the condenser due to external air, it is necessary not to bypass an air flow path through which the external air drawn into the mechanical chamber passes through the condenser.

Accordingly, there is a need to develop a refrigerator having an arrangement structure of a machine room that forms an air flow guide for air passing through a condenser, while securing assembly reliability of the condenser and a blower fan module, thereby enhancing a heat dissipation effect of the condenser.

SUMMARY

One objective of the present disclosure is to provide a refrigerator having a structure of arranging components inside a machine room, which may minimize air circulation path interference between a plurality of air circulation cycles, while providing independent circulation cycles in a plurality of spaces defined in the machine room.

Another objective of the present disclosure is to provide a refrigerator having a structure of arranging components inside a machine room, which may increase the ratio of external air drawn into the machine room and reduce the ratio of air discharged from the machine room to be immediately re-drawn.

A further objective of the present disclosure is to provide a refrigerator including a guide fan that may fix a condenser and a blower fan module with high assembly reliability.

A still further objective of the present disclosure is to provide a refrigerator including a guide fan that may form a structure of an air flow guide shape only by its structure.

A still further object of the present disclosure is to provide a refrigerator including a securing portion for securing a condenser and a blower fan module, the securing portion that may be realized by one mold.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

To overcome the above-noted disadvantages, a refrigerator according to an embodiment may include a storage compartment; and a machine room including a first machine room and a second machine room which are disposed side by side in a left-right direction, wherein air introduced into the first machine room may be discharged outside through a first circulation path, air introduced into the second machine room may be discharged outside through a second circulation path, and the first circulation path and the second circulation path may have circulation directions that are opposite to each other.

According to an embodiment of the present disclosure to solve the above objectives, a refrigerator may include a storage compartment; a machine room forming a space independent of the storage compartment; a support portion extending in a front-rear direction of the machine room to divide the machine room into a first machine room and a second machine room disposed side by side in a left-right direction; a first condenser and a first compressor disposed in the first machine room; and a second condenser and a second compressor disposed in the second machine room.

In this case, the first condenser and the first compressor may be disposed adjacent to the support portion with respect to a left-right direction of the first machine room. The second condenser and the second compressor may be disposed adjacent to the support portion with respect to a left-right direction of the second machine room.

To overcome the above-noted disadvantages, a refrigerator according to an embodiment may include a storage compartment; and a machine room including a first machine room and a second machine room which are disposed side by side in a left-right direction; and a grille cover disposed on a front surface of the machine room, and introducing and discharging air.

In this case, the grille cover may include an air inlet introducing the air into the machine room; and a first air outlet and a second air outlet, which are disposed on both sides of the air inlet and discharging the introduced air to the outside.

According to an embodiment of the present disclosure to solve the above objectives, a refrigerator may include a storage compartment; a machine room forming a space independent of the storage compartment; and a guide fan unit disposed in the machine room.

In this case, the guide fan unit comprises, a condenser; a blower fan module blowing air to pass through the condenser; and a guide fan comprising a first mounting portion to which the condenser is mounted, and a second mounting portion to which the blower fan module is mounted, and the second mounting portion may include an air ventilation hole open toward the condenser.

In an embodiment of the present disclosure, the first mounting portion and the second mounting portion may be integrally formed with the guide fan.

In an embodiment of the present disclosure, the first mounting portion may include a first holder and a second holder that fixes one side and the other side of the condenser, respectively, and the first holder and the second holder may have open tops so that the condenser is inserted and coupled to the first holder and the second holder in an up-down direction.

In an embodiment of the present disclosure, the refrigerator may further include an upper surface extension extending from an upper end of the second mounting portion in a direction in which the condenser is disposed; and a lower surface extension extending a lower end of the second mounting portion in the direction in which the condenser is disposed, and an outer circumferential portion of the upper surface extension may be formed along a shape of the tube to be spaced a preset distance apart from the tube.

In an embodiment of the present disclosure, a first support portion, a second support portion and a lower wall may be disposed on the lower surface extension.

In the refrigerator according to the present disclosure, the air introduced into the first machine room may be discharged outside through the first circulation path and the air introduced into the second machine room may be discharged outside through the second circulation path having an air circulation direction opposite to an air circulation direction of the first circulation path. Accordingly, heat dissipation performance and efficiency may be improved by minimizing interference with the air circulation paths, which might occur between air circulation cycles for circulating through the first machine room and the second machine room, respectively.

In the refrigerator according to the present disclosure, the first condenser and the first compressor of the first machine room and the second condenser and the second compressor of the second machine room may be disposed adjacent to the support portion. Due to this structure, the first air outlet of the first machine room and the second air outlet of the second machine room may be spaced as apart as possible on both sides with respect to the air inlet shared by the first machine room and the second machine room. Accordingly, heat dissipation performance and efficiency may be improved by minimizing interference with the air circulation paths, which might occur between air circulation cycles for circulating through the first machine room and the second machine room, respectively.

In the refrigerator according to the present disclosure, the first condenser and the first compressor of the first machine room and the second condenser and the second compressor of the second machine room may be disposed adjacent to the support portion. Due to this structure, the boundary surface between the air inlet and the air outlet may be minimized and the distance between boundary surfaces may be spaced apart as much as possible. Accordingly, the radio of external air introduced into the machine room may be increased and the ratio of the air discharged from the machine room being immediately re-introduced with respect to the boundary surface, thereby increasing the heat dissipation performance and efficiency of the machine room.

In addition, in the refrigerator according to the present disclosure, the first mounting portion for mounting the condenser to the guide fan and the second mounting portion for mounting the blower fan module may be provided. Accordingly, the condenser and the blower fan module may be mounted to one guide fan, thereby securing high assembly reliability.

In addition, in the refrigerator according to the present disclosure, the upper surface extension may extend from the upper end of the second mounting portion of the guide fan in the direction in which the condenser is disposed, and may form the external air flow path guide shaped structure. Accordingly, the air may pass through the condenser through the air flow path guide shaped structure, which is its own structure, without being bypassed to the top of the condenser as much as possible, thereby improving the heat dissipation performance of the condenser.

In addition, in the refrigerator according to the present disclosure, the lower surface extension may extend from the upper end of the second mounting portion of the guide fan in the direction in which the condenser is disposed, and the lower wall may be disposed on the lower surface extension, so as to form the external air flow path guide shaped structure. Accordingly, the air may pass through the condenser through the air flow path guide shaped structure, which is its own structure, without being bypassed to the top of the condenser as much as possible, thereby improving the heat dissipation performance of the condenser.

In addition, in the refrigerator according to the present disclosure, the first mounting portion including the first holder and the second holder having open tops and the second mounting portion including the air ventilation hole open toward the condenser, to insertedly mount the condenser in the up-down direction, may be provided in one guide fan, thereby realizing the guide fan with one mold and increasing process efficiency.

Specific effects are described along with the above-described effects in the section of detailed description.

DETAILED DESCRIPTIONS

Figure 1:
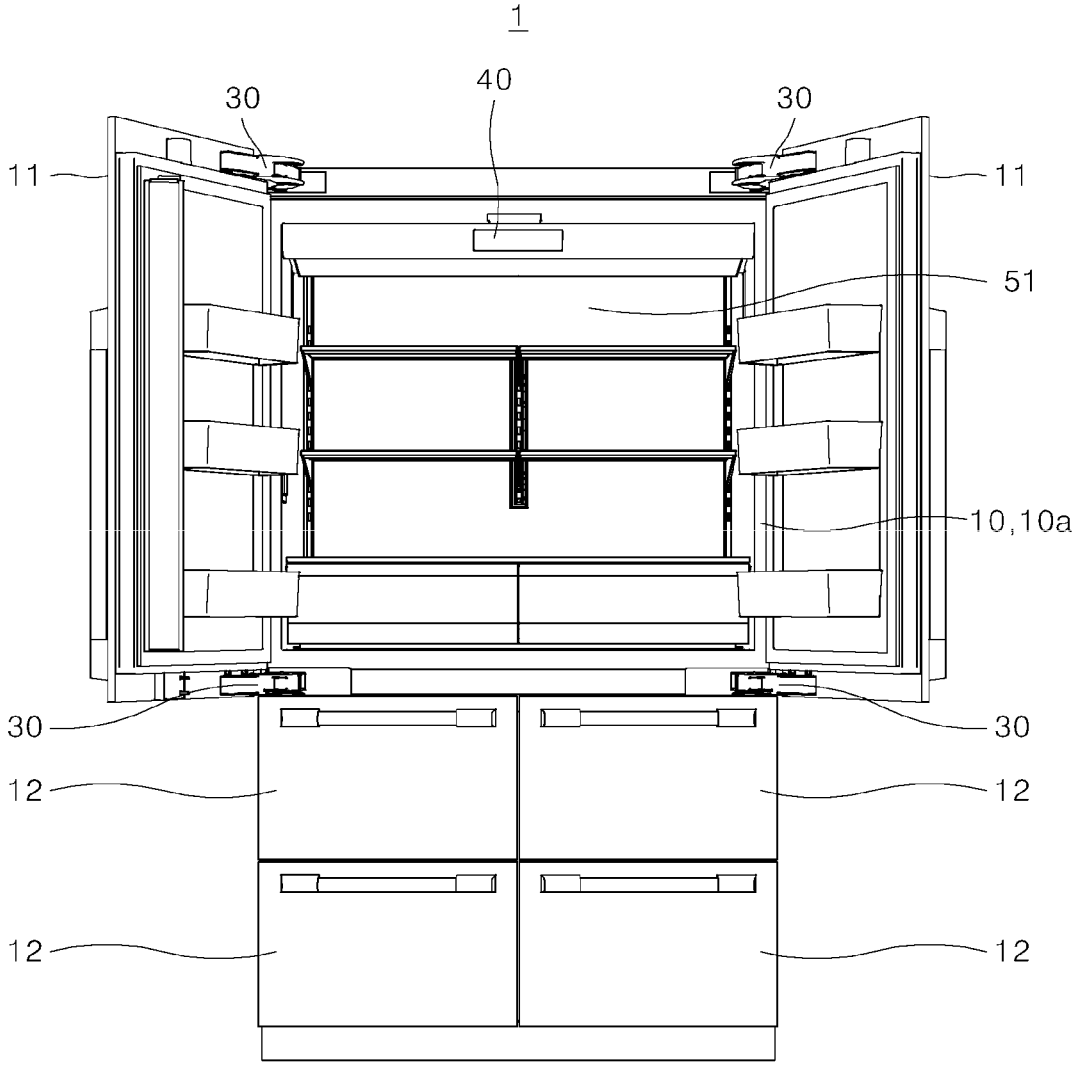
FIG. 1 is a front view of a refrigerator in which a first door is open.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a refrigerator according to several embodiments will be described.

Figure 2:
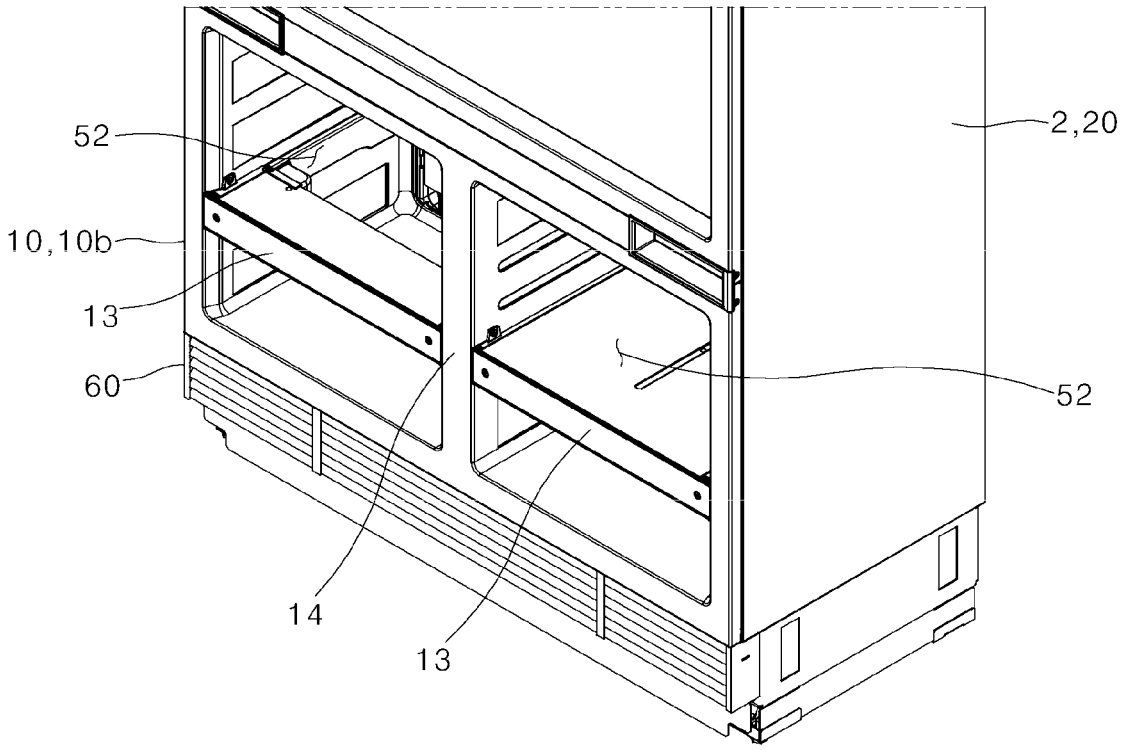
FIG. 2 is a front perspective view showing a second inner case in a state where a second door is eliminated and a machine room disposed in a lower area of the second inner case.

Referring to FIGS. 1 and 2, the refrigerator 1 according to an embodiment of the present disclosure and key parts consisting of the refrigerator will be described.

An up-down direction, a left-right direction and a front-back direction described therein are based on a viewpoint when a user located in front of the refrigerator 1 looks at the refrigerator 1, unless otherwise specified.

The exterior design of the refrigerator 1 may be defined by a cabinet 2 including one or more storage compartments 51 and 52, and a plurality of doors 11 and 12 for opening an open front of the cabinet 2.

The cabinet 2 may include an outer case 20 and an inner case 10 coupled to an inside of the outer case 20.

An insulation material is filled between the inner case 10 and the outer case 20 to insulate the storage compartments 51 and 52.

The cabinet 2 may have a box shape with an open front, and may be divided into one or more storage spaces to have a refrigerator compartment and/or a freezer compartment.

In the inner case 10, the first inner case 10*a* may be disposed in an upper area and the second inner case 20*a* may be disposed in a lower area.

In this instance, the first inner case 10*a* may include at least one storage compartment 51 or the first storage compartment 51 may be a refrigerator compartment. The second inner case 10*b* may include at least one second storage compartment 52.

However, the present disclosure is not limited thereto, and the first storage compartment 51 may be a freezer compartment and the second storage compartment 52 may be a refrigerator compartment. The first and second storage compartments may be convertible type storage compartments that can be converted into refrigerator and refrigerator compartments.

A display unit 40 may be disposed in an inner upper area of the first storage compartment 51, and may provide an interface so that a user can adjust the temperature of the convertible type storage compartment.

In addition, the second inner case 10*b* may be divided into a plurality of second storage compartments 52 by a boundary portion 14 extending in a vertical direction and dividing the space of the second inner case 10*b*.

The plurality of second storage compartments 52 may include a barrier 13 horizontally extending from the center area to partition off space of each second storage compartment 52 into a plurality of spaces, but the present disclosure is not limited thereto.

A first storage compartment 51 of the first inner case 10*a* may be open and closed by a pair of first doors 11 rotatable by a hinge.

The second storage compartment 52 of the second inner case 10*b* may be open and closed by a plurality of drawer-type second doors 12 retractable by a rail.

In the present disclosure, the plurality of second doors 12 may be four doors, and may open and close the second storage compartment 52 including four storage chambers divided by the boundary portion 14 and two barriers 13, but the present disclosure is not limited thereto.

Figure 3:
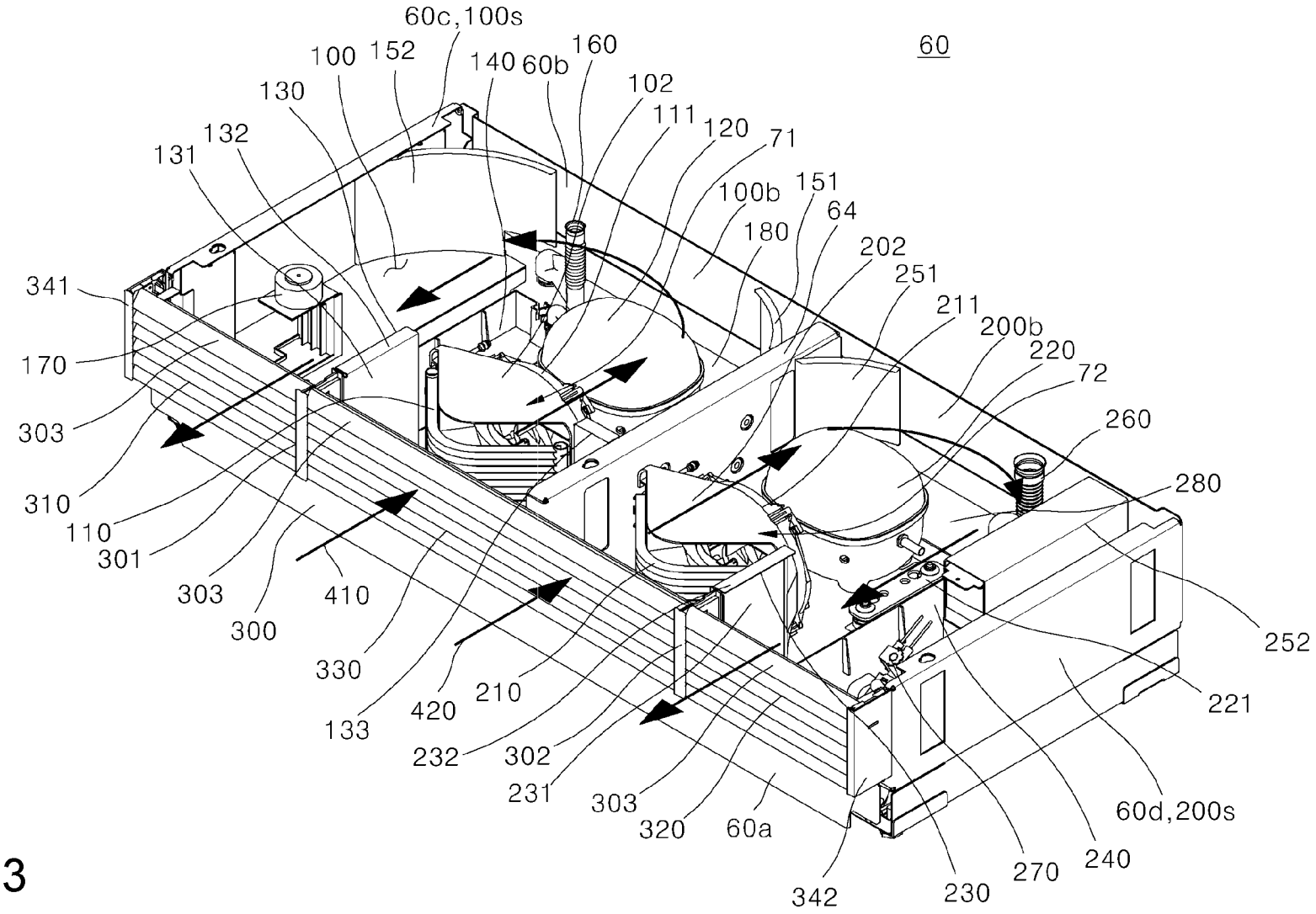
FIG. 3 is a perspective showing a machine room.
Figure 4:
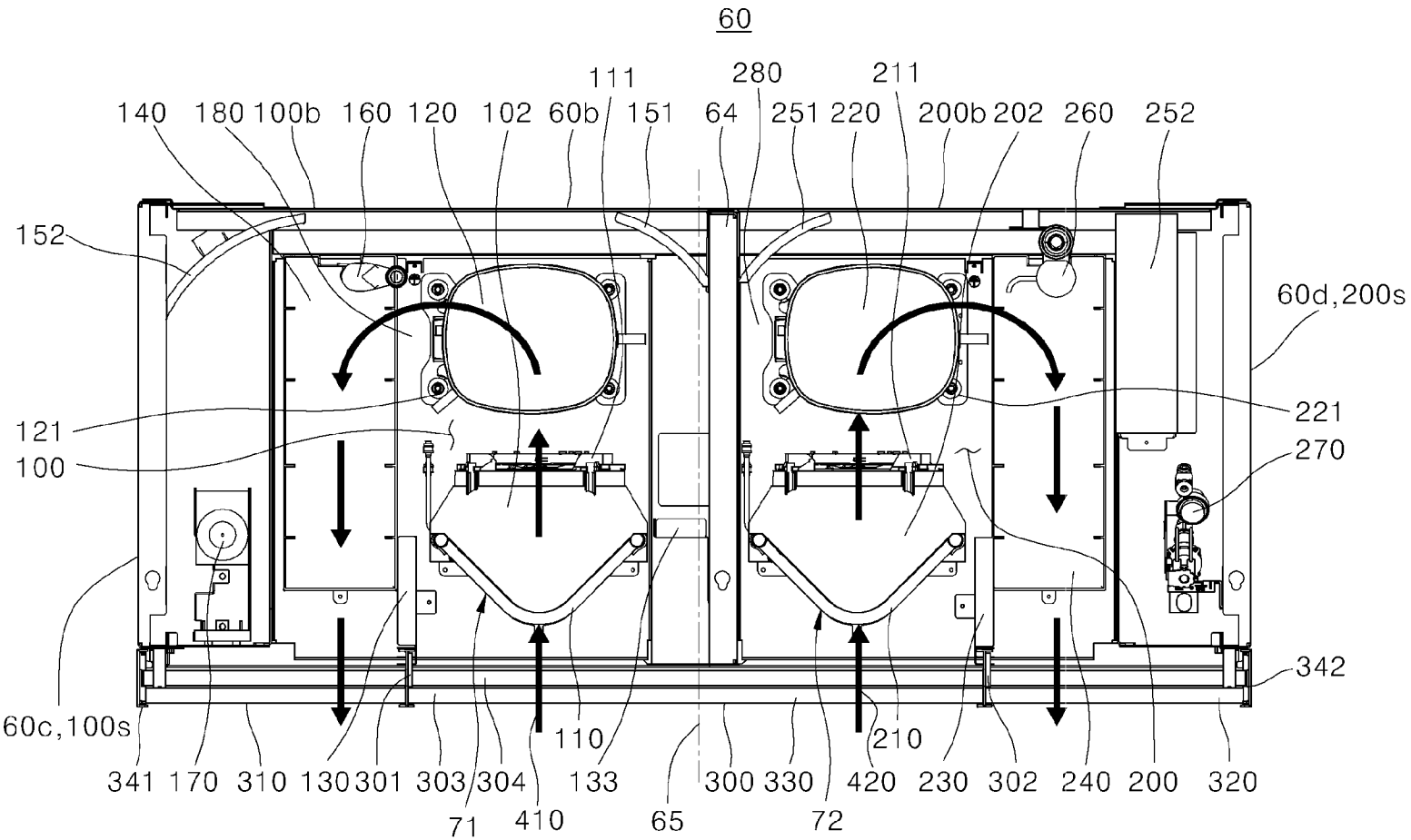
FIG. 4 is a plan view showing a machine room.

Hereinafter, further referring to FIGS. 3 and 7, a machine room 60 according to an embodiment of the present disclosure and key parts consisting of the machine room 60 will be described.

The machine room 60 may be disclosed in a lower area of the cabinet 2, specifically, on a lower end of the second inner case 10*b*.

The machine room 60 may be formed as a space independent of the cabinet 2, and thus may be formed as a space independent of the storage compartments 51 and 52 provided in the cabinet 2.

Hereinafter, the cabinet 2 and the machine room 60 are described in a narrow sense in which they are separated from each other, but the present disclosure is not limited thereto.

For example, the cabinet 2 may be described in a broad sense including not only the storage compartments 51 and 52 but also the machine room 60.

The machine room 60 may form a space in which a plurality of electrical control components constituting the cooling cycle for cooling the storage compartments 51 and 52 are disposed.

Accordingly, the machine room 60 may have a shape capable of providing a storage space accommodating the components for the cooling cycle such as condensers 110, 210, blower fan modules 111, 211 and compressors 120 and 220.

For example, the machine room 60 may have an exterior design including a front surface 60*a*, a lower surface 60*e*, a first outer lateral surface 60*c* and a second outer lateral surface 60*d*, with an open top.

A plurality of wheels 66 may be formed on a lower surface 60*e* of the machine room 60 to facilitate each movement of the refrigerator 1.

When the machine room 60 is disposed under the second inner case 10*b*, the lower surface of the second inner case 10*b* may serve as an upper surface of the machine room 60 while covering the top of the machine room 60.

Upper surfaces of the first outer lateral surface 60*c* and the second outer lateral surface are curved inward to provide a support surface capable of stably supporting the lower surface of the second inner case 10*b*.

However, the present disclosure is not limited thereto, and the upper surface of the machine room 60 may be formed as a separate part from the lower surface of the second inner case 10*b* to cover the top of the machine room 60.

The front surface 60*a* of the machine room 60 may have a height that is lower than the rear surface 60*b*, the first outer surface 60*c* and the second outer lateral surface 60*d*.

For example, the front surface 60*a*, the rear surface 60*b*, the first outer lateral surface 60*c* and the second outer lateral surface of the machine room 60 may extend upward from the lower surface 60*e*, with a lower height than the rear surface 60*d* and both lateral surfaces 60*c* and 60*d*.

A grille cover 300 may be disposed in an area as large as the height of the lowered front surface 60*a* of the machine room 60 above the front surface 60*a* of the machine room 60.

The grille cover 300 may serve a role of facilitating communication between the machine room 60 and an outer space to cool or heat-exchange the components inside the machine room 60 by sucking external air into the machine room 60 and discharging the air circulating inside the machine room 60 to the outside.

The grille cover 300 may be formed to protrude more forward than the front surface 60*a* of the machine room 60.

Figure 7:
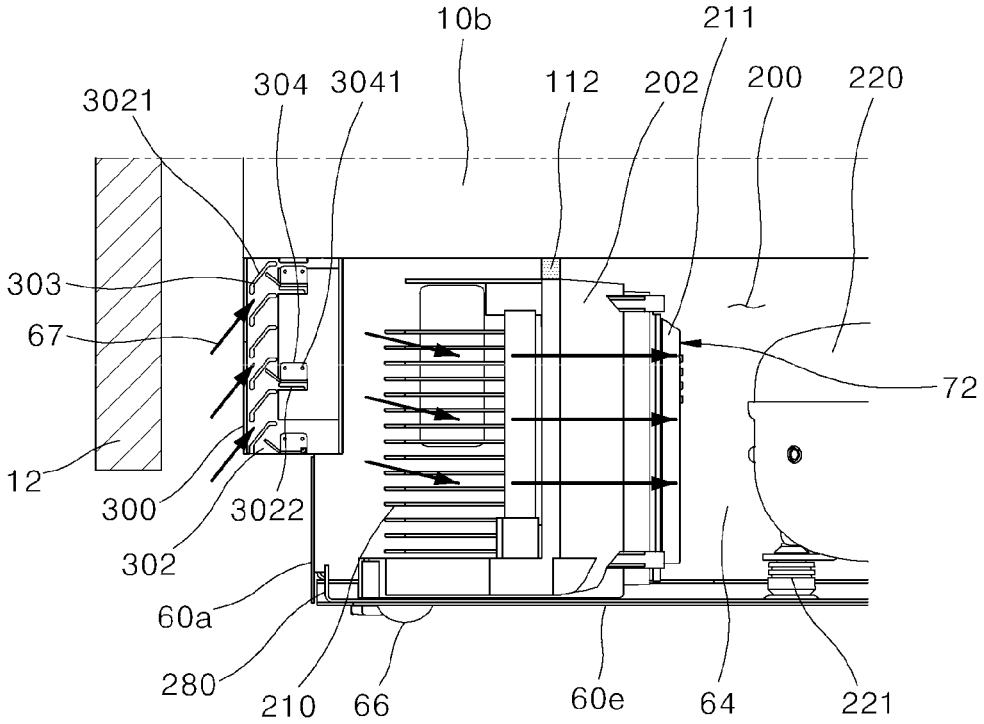
FIG. 7 is a side sectional view of a machine room in a state where a second door is coupled.
Figure 8:
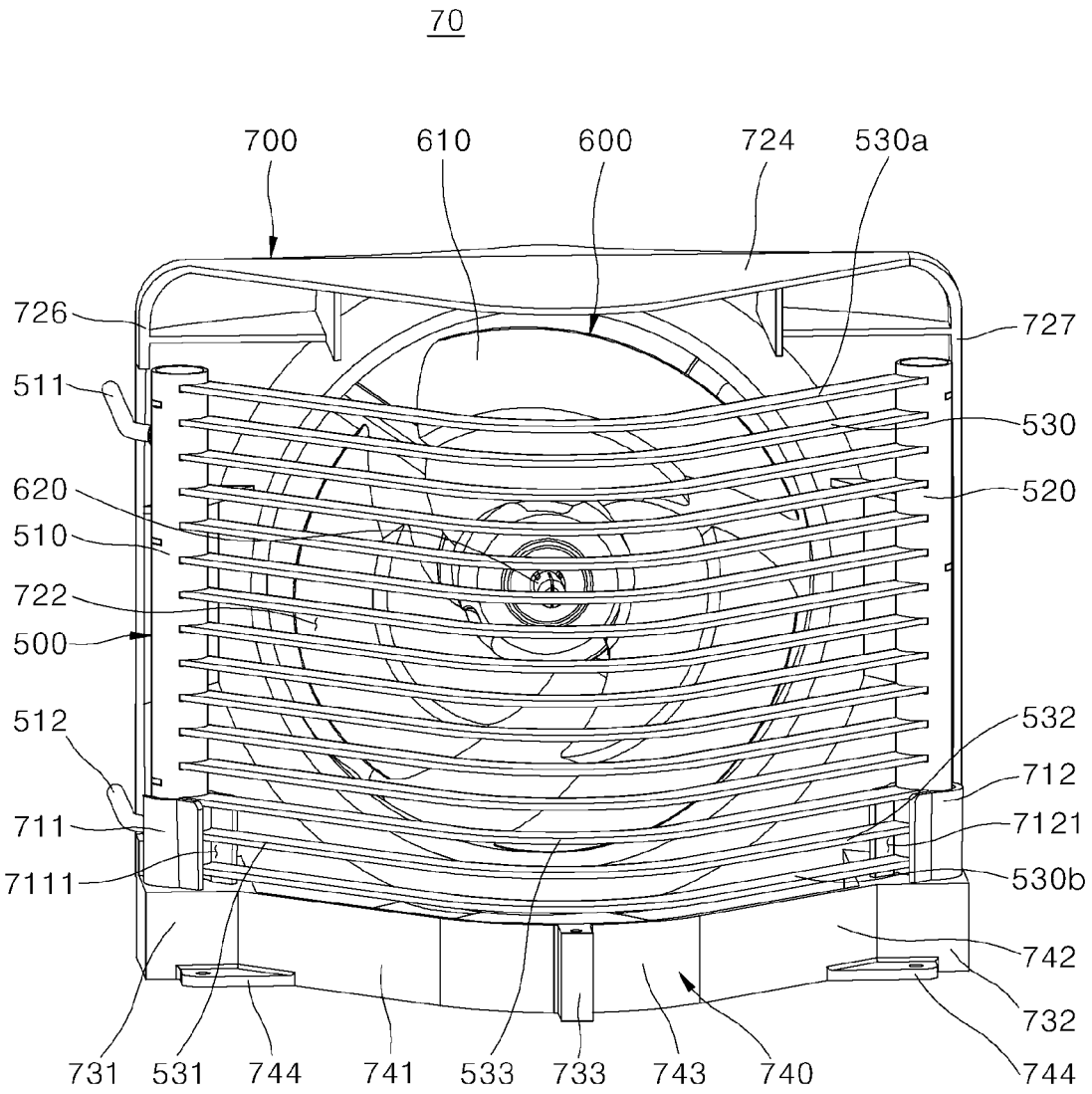
FIG. 8 is a perspective view of a front surface of a guide fan unit.
Figure 9:
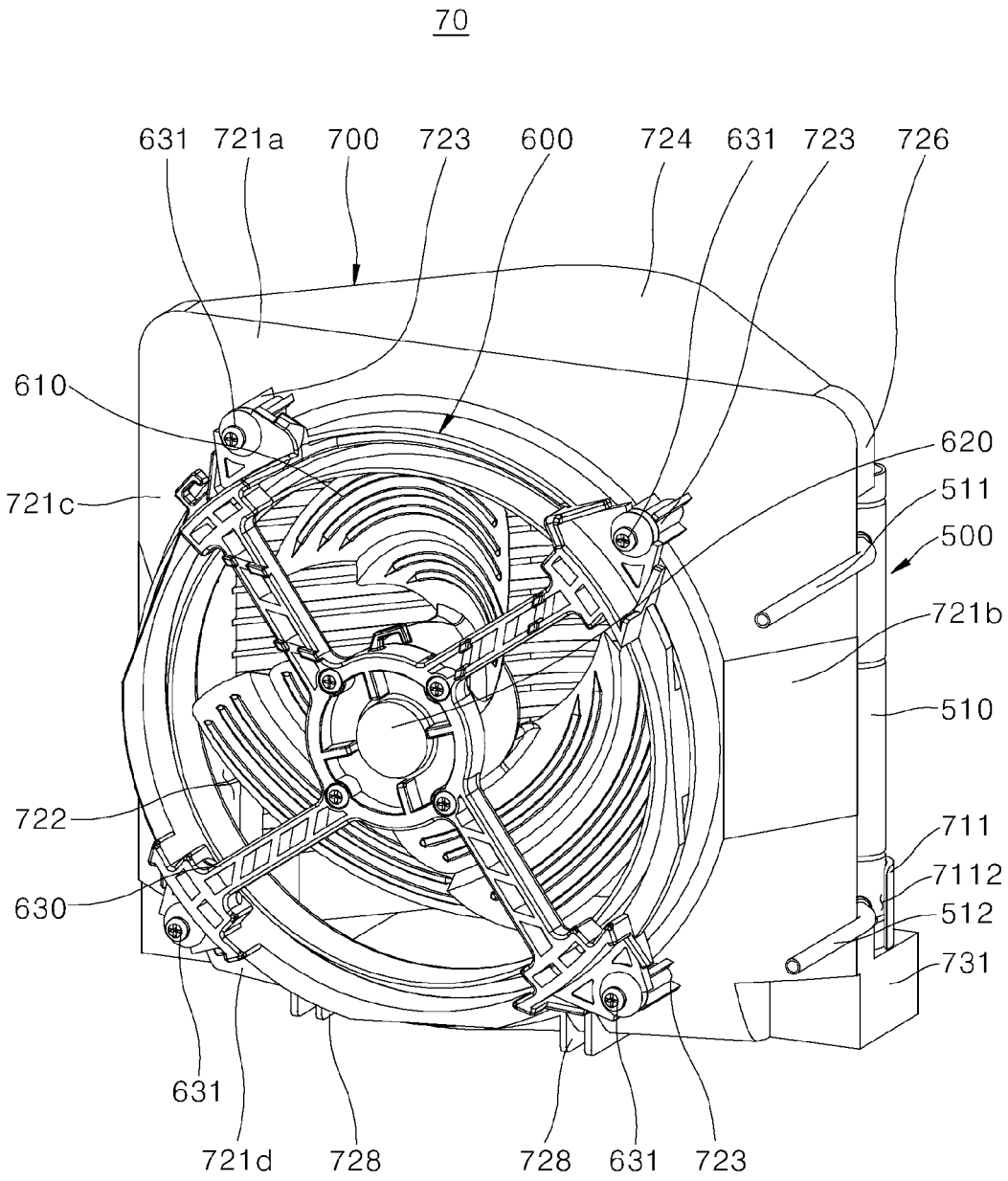
FIG. 9 is a perspective view of a rear surface of a guide fan.
Figure 10:
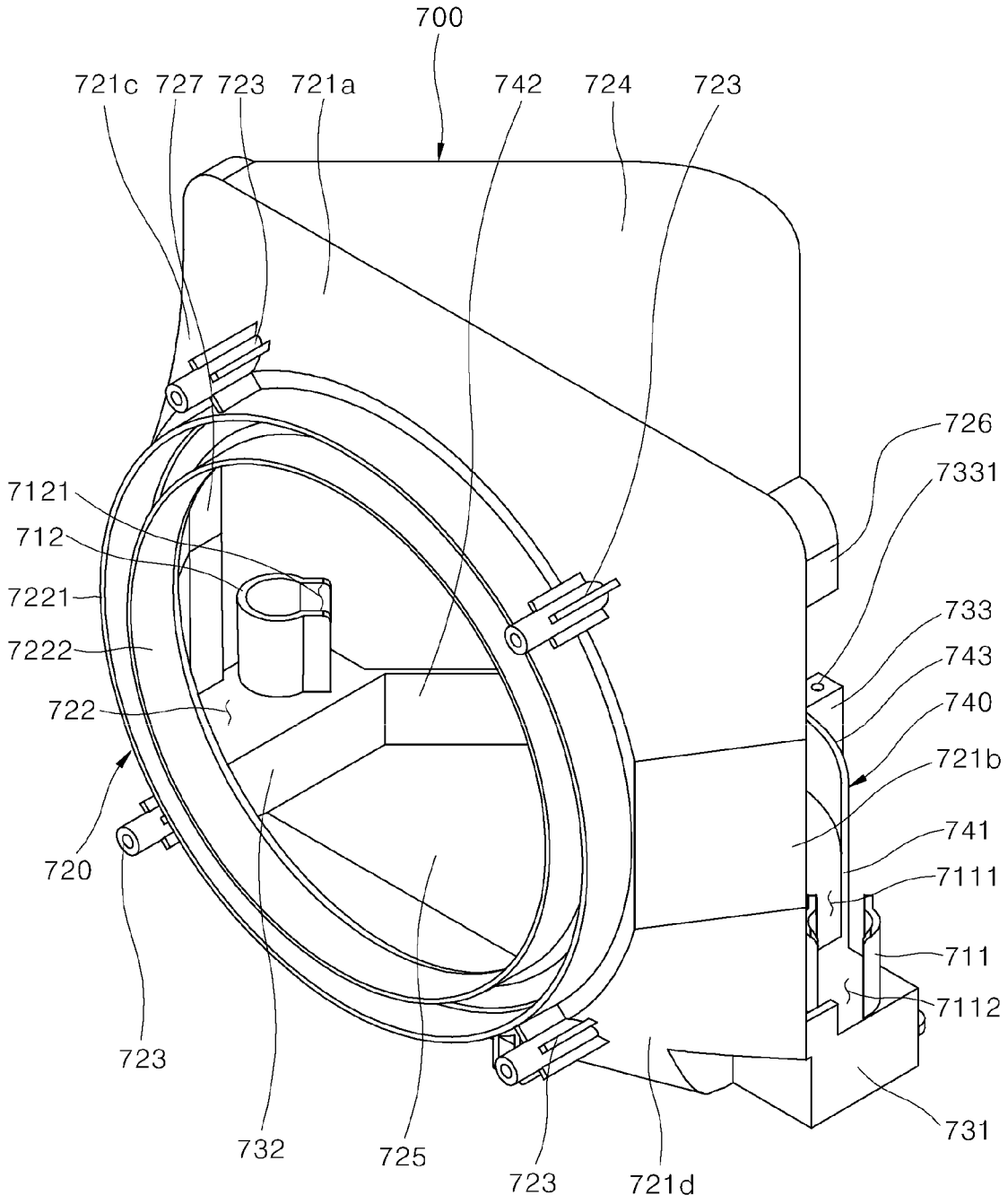
FIG. 10 is a perspective of a rear surface of a guide fan.
Figure 11:
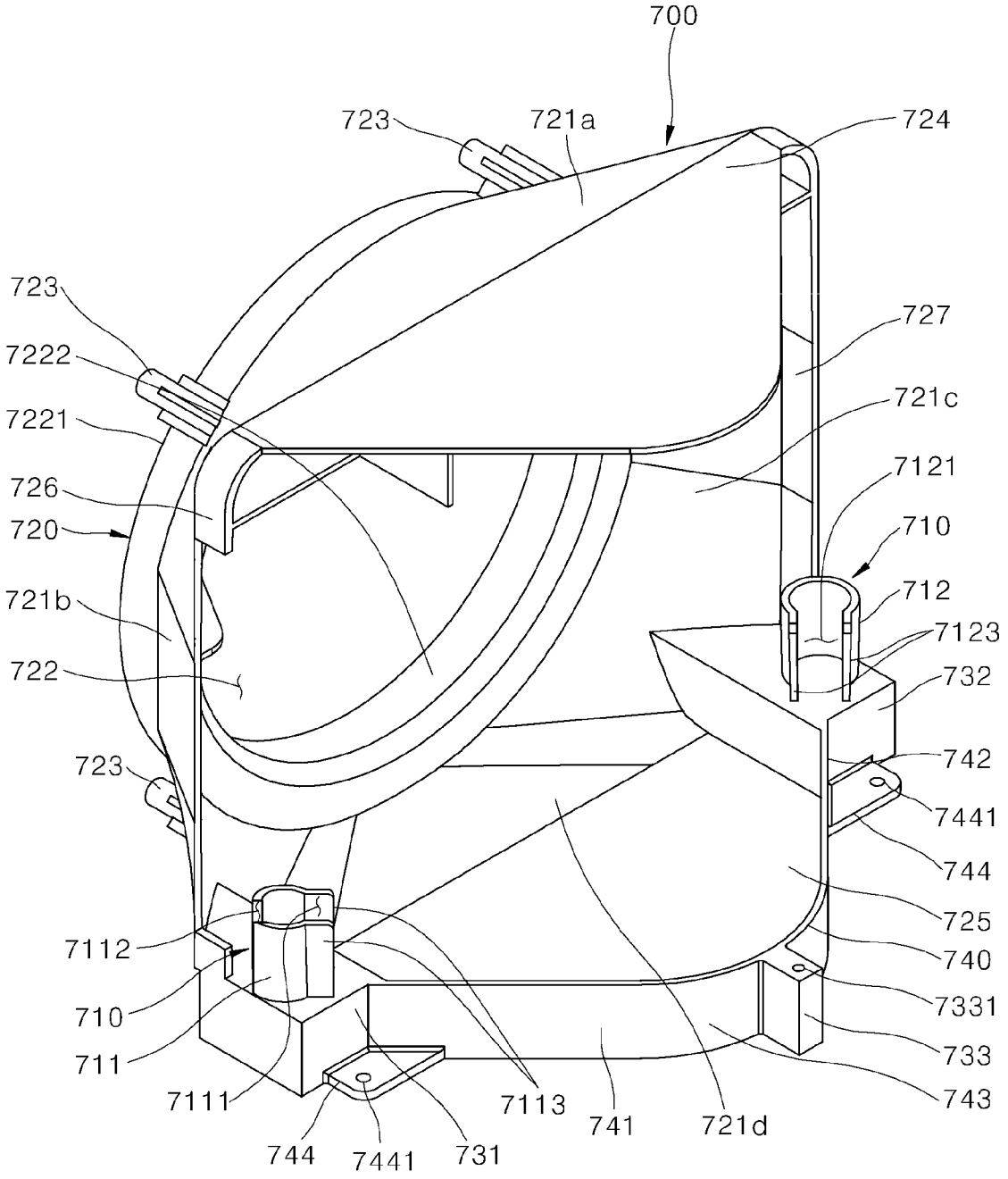
FIG. 11 is a perspective view of a front surface of a guide fan.

Referring to FIG. 7, at least one second door 12 for opening and closing the second storage chamber 52 may be coupled to a front surface of the grille cover 300. When seen from the front surface, the grille cover 300 may be disposed to overlap a power area of the second door 12 with respect to a front-rear direction of the machine room 60 not to be exposed to the outside in the front direction of the refrigerator 1.

In other words, when a user sees the refrigerator 1 from the front surface, the grille cover 300 may be disposed to overlap the lower area of the second door 12 so that it may not be exposed to the outside from the front surface of the refrigerator 1.

Accordingly, when the user sees the refrigerator 1 in front, the grille cover 300 is hidden by the lower end of the second door 12 and only the front surface 60*a* of the machine room 60 disposed under the grille cover 300 may be exposed to the outside.

In a state where the second door 12 is closed, the grille cover 300 may not be exposed to the outside and then the design beauty of the refrigerator 1 may be improved.

The grille cover 300 may include a plurality of guide ribs 303 vertically extending to be spaced apart from each other.

A first lateral surface finishing portion 341 and a second lateral surface finishing portion 342 may be disposed at both ends of the plurality of guide ribs 303, respectively, to finish both side ends of the grille cover 300.

An outer lateral surface of the first lateral surface finishing portion 341 may form one lateral surface of the machine room 60, together with the first outer lateral surface 100*s* of the machine room 60.

The first lateral surface finishing portion 341 may extend in the up-down direction to correspond to the plurality of ribs arranged in the up-down direction, when viewed from one lateral surface, and may have a plate shape extending in a front-rear direction to protrude more rearward than the plurality of guide ribs 303.

In addition, some area of the first lateral surface finishing portion 341 may protrude more forward than the plurality of guide ribs 303 to recognize the location of the first lateral surface finishing portion on the front surface of the grille cover 300.

In addition, the first lateral surface finishing portion 341 may have a width that is narrow in the left-right direction, seen from the front surface.

In this instance, the front-rear direction length of the first lateral surface finishing portion 341 may be shorter than the up-down direction thereof, but the present disclosure is not limited thereto.

The plurality of guide ribs 303 may be provided in front of an inner surface of the first lateral surface finishing portion 341.

An outer lateral surface of the second side finishing portion 342 may form the other surface of the machine room 60, together with the second outer lateral surface 60*d* of the machine room 60.

The second lateral surface finishing portion 342 may extend in the up-down direction to correspond to the plurality of guide ribs arranged in the up-down direction, seen from the other lateral surface, and it may have a plate shape extending in the front-rear direction to protrude more rearward than the plurality of guide ribs 303.

In addition, some area of the second lateral surface finishing portion 342 may be formed to protrude more forward than the plurality of guide ribs 303 to recognize the position of the second lateral surface finishing portion 3432 on the front surface of the grille cover 300.

In addition, the second lateral surface finishing portion 342 may have a narrow width in the left-right direction, seen from the front surface.

In this instance, the front-rear direction length of the second lateral surface finishing portion 342 may be shorter than the up-down direction length, but the present disclosure is not limited thereto.

The plurality of guide ribs 303 may be in front of an inner surface of the second lateral surface finishing portion 342.

The plurality of guide ribs 303 may be vertically arranged so that they may incline upward from the front to the rear.

Since the second door 12 is coupled to the front surface of the grille cover 300, the second door 12 might interfere with inflow of external air in case external air 67 flows in through the front surface.

However, in the embodiment of the present disclosure, the plurality of guide ribs 303 may inclinedly arranged upward to the rear from the front. Accordingly, the external air 67 introduced from the front surface of the grille cover 300 can flow to flow to be inclined from a lower diagonal direction to an upper diagonal direction.

Even if the second door 12 is disposed on the front surface of the grille cover 300, interference with external air inflow due to the second door 12 may be minimized so that efficient external air intake can be achieved along with improved design beauty.

In addition, since the plurality of guide ribs 303 are inclined upward from the front toward the rear as described in the embodiment of the present disclosure, they may serve as a shield to prevent the components inside the machine room 60 from being exposed to the outside to the user even in a state where the second door 12 is open.

Accordingly, in the embodiment of the present disclosure, regardless of whether the second door 12 is open, not only the design beauty may be maintained but also the intake of external air through the grille cover 300 may be efficiently achieved by minimizing interference due to the second door 12.

Meanwhile, as becomes larger, the left-right direction width of the machine room 60 becomes linger, with the trend that the refrigerator 1, an additional support component for supporting the plurality of guide ribs 303 extending in the left-right direction of the machine room 60 could be required.

To this end, the grille cover 300 may include a first partition portion 301 and a second partition 302 for supporting the plurality of guide ribs 303 may be provided between the first lateral surface finishing portion 341 and the second lateral surface finishing portion 342.

The first partition portion 301 and the second partition portion 302 may have shapes corresponding to the first lateral surface finishing portion 341 and the second lateral surface finishing portion 342, respectively.

Accordingly, the first partition portion 301 and the second partition portion 302 may extend in a vertical direction to correspond to the plurality of guide ribs 303 arranged in the vertical direction, when viewed from one side.

In addition, a predetermined area of each of the first and second partition portions 301 and 302 may extend more forward than the plurality of guide ribs 303 so that the front surface of the grille cover 300 may recognize the positions of the first and second partition portions 301 and 302.

In addition, the first partition portion 301 and the second partition portion 302 may be formed to have a narrow width in the left-right direction, viewed from the front surface.

In this instance, the front-rear direction length of each of the first and second partition portions 301 and 302 may be formed shorter than the up-down direction length, but the present disclosure is not limited thereto.

The first partition portion 301 may be disposed closer to the first lateral surface finishing portion 341 than the second lateral surface finishing portion 342, specifically, between a center line 65 with respect to the left-right direction of the machine room 60 and the first lateral surface finishing portion 341.

For example, a distance between the first lateral surface finishing portion 341 and the first partition portion 301 may be equal to a distance between the first partition portion 301 and the center line 65.

The second partition portion 302 may be closer to the second lateral surface finishing portion 342 than the first lateral surface finishing portion 341, specifically, between a center line 65 with respect to the left-right direction of the machine room 60 and the second lateral surface finishing portion 342.

For example, a distance between the second lateral surface finishing portion 342 and the second partition portion 302 may be equal to a distance between the second partition portion 302 and the center line 65.

Accordingly, the first lateral surface finishing portion 2, the first partition portion 301, the second partition portion 302 and the second lateral surface finishing portion 342 may be sequentially spaced apart from each other along the direction in which the plurality of guide ribs 303 extend.

In this instance, the first partition portion 301 and the second partition portion 302 may include a plurality of first inserting portions 3021 penetrated by the plurality of guide ribs 303.

The first inserting portion 3021 may have a through-hole shape for supporting the guide rib 303 penetrating it in the left-right direction.

The plurality of first inserting portions 3021 may be arranged to be spaced apart from each other in the up-down direction in front areas of the first partition portion 301 and the second partition portion 302.

In addition, the plurality of first inserting portions 3021 may be inclined upward from the front toward the rear.

Accordingly, the plurality of first inserting portions 3021 may determine positions and inclined angles of at which the plurality of guide ribs 303 fixedly inserted in the plurality of first inserting portions 3021, respectively, are inclinedly arranged.

The grille cover 300 may further include a plurality of support ribs 304 extending in the left-right direction of the machine room 60 to be spaced apart in the up-down direction.

The support rib may have the length that is substantially equal to the guide rib 303, but the present disclosure is not limited thereto.

The first lateral surface finishing portion 341 and the second lateral surface finishing portion 342 may be disposed at both ends of the plurality of support ribs 304, respectively. Both ends of the plurality of support ribs 304 may be bent to form a support surface that is in contact with an inner surface of the support rib 304.

A coupling portion 3041 may be formed on the surface bent at both ends of the plurality of support ribs 304, and may be fixedly coupled to each of the first and second lateral surface finishing portions 341 and 342.

For example, the coupling portion 3041 may be formed in a shape of a fastening hole through which a fastening member such as a screw can pass, respectively.

In this instance, the first partition portion 301 and the second partition portion 302 may further include a plurality of second inserting portions 3022 penetrated by the plurality of support ribs 304.

The second inserting portion 3022 may be formed in a through-hole for supporting the support rib inserted to penetrate in the left-right direction.

The plurality of second inserting portions 3022 may be arranged to be spaced apart in rear areas of the first and second partition portions 301 and 302 in the up-down direction.

The plurality of support ribs 304 secured to the second inserting portions 3022 of the first partition portions 301 and the second partition portions 302 may not only serve to fix the first lateral surface finishing portion 341 and the second lateral surface finishing portion 342 positioned at both ends, respectively, but also support the grille cover 300 while providing a strength required to maintain the entire shape of the grille cover 300.

Meanwhile, the machine room 60 may be divided into a plurality of spaces. For example, a first machine room 100 and a second machine room 200 may be disposed side by side in the left-right direction.

Accordingly, the first machine room 100 and the second machine room 200 may be disposed side by side on the rear surface of the grille cover 300 so as to independently fluidly communicate with the rear surface of the grille cover. Then, the external air introduced from the grille cover 300 may form separate circulation paths in the first machine room 100 and the second machine room 200, respectively.

The machine room 60 may include a support portion 64 extending in the front-rear direction of the machine room 60 to divide it into a first machine room 100 and a second machine room 200.

For example, the support portion 64 may extend in the front-rear direction to overlap the center line 65 along the center line 65 with respect to the left-right direction of the machine room 60, but the present disclosure is not limited thereto.

For example, the support portion 64 may be disposed between a first outer lateral surface 60*c* of the machine room 60 and the center line 65, or between a second lateral surface thereof and the center line 65.

Even in this instance, the support portion 65 may be arranged adjacent to the center line 65 so that the left-right width of the first machine room 100 and that of the second machine room 200 can become similar.

However, hereinafter, the case in that the support portion 64 is disposed between the second outer lateral surface 60*d* and the center line 65 will be described as one embodiment.

The support portion 64 may serve as a partition wall that partitions the machine room 60 into a plurality of spaces.

In addition, the support portion 64 is also formed to have a predetermined width in the left-right direction, such that an upper surface of the support portion 64 may serve as a support wall supporting a lower surface of the second inner case 10*b*.

Accordingly, the support portion 64 may also serve as a reinforcing portion reinforcing the strength to support the weight of the refrigerator 1 from the bottom, with the trend that the large-sized refrigerator 1.

The first machine room 100 and the second machine room 200 divided as separate spaces may be in communication with separate storage compartments, respectively, to provide separate cooling cycles.

For example, the first machine room 100 may fluidly communicate with the freezer compartment and the second machine room 200 may fluidly communicate with the refrigerator compartment to provide separate cooling cycles, respectively.

To this end, in the first machine room 100 and the second machine room 200, independent condensers, blower fan modules and compressors may be disposed, respectively.

The compressor may compress and supply a refrigerant into a high-temperature-and-high-pressure refrigerant. The compressor may dissipate the high-temperature-and-high-pressure refrigerant supplied from the compressor. The blower fan module may forcibly blow air inside the machine room 60.

Specifically, a first condenser 110, a first blower fan module 111 and a first compressor 120 may be sequentially disposed in the first machine room 100 from the front to the rear with respect to the rear surface of the grille cover 300.

The first condenser 110, the first blower fan module 111 and the first compressor 120 may be disposed on the lower surface 60*e* of the machine room 60.

In this instance, a first base plate 180 may be disposed on the lower surface 60*e* of the first machine room 100.

Accordingly, the first condenser 110, the first blower fan module 111 and the first compressor 120 may be secured to a first base plate 180.

The first base plate 180 may be moved forward in a state where the grille cover 300 is removed, so that internal components disposed inside the first machine room 100 can be easily repaired.

Accordingly, in case the first base plate 180 is moved forward, the first condenser 110, the first blower fan module 111 and the first compressor 120 may be moved also forward.

The first condenser 110 and the first blower fan module 111 may be coupled to a first guide fan 102. The first guide fan 102, the first condenser 110 and the first blower fan module 11 may form a first guide fan unit 71.

Accordingly, the first condenser 110 and the first blower fan module 111 mounted to the first guide fan 102 may be fixed on the first base plate 180 as a first guide fan unit 71.

The first compressor 120 may have a plurality of fixing portions 121 for reducing vibration and provide a stronger fixing force so that the first compressor 120 may be fixed to the first base plate 180, but the type of the fixing is not limited thereto.

The first condenser 110, the blower fan module 111 and the first compressor 120 may be disposed side by side in one direction to overlap each other with respect to the front-rear direction.

In addition, the condenser 110, the first blower fan module 111 and the first compressor 120 may be disposed adjacent to the support portion 64 with respect to the left-right direction of the first machine room 100.

Accordingly, when the first blower fan module 111 is operated, external air 67 may flow into the first machine room 100 in a direction close to the support portion 64 with respect to the left-right direction of the first machine room 100.

The external air 67 introduced from the grille cover 300 provided in the front area may dissipate the first condenser 110, and then pass through the first blower fan module 111 sequentially to cool the first compressor 120.

The area in which the external air 67 is introduced through the grille cover 300 may be defined as an air inlet 330.

The air inlet 330 of the first machine room 100 may be formed between the first partition portion 301 and the support portion 64.

In order to induce the external air introduction through the air inlet 330, a first front surface air guide 130 may be disposed in a rear area of the first partition portion 301.

The first front surface air guide 130 may be disposed so that the first condenser 110, the first blower fan module 111 and the first compressor 120 may be disposed between the first front surface air guide 130 and the support portion 64.

The first front surface air guide 130 may be formed to have a height equal or similar to the support portion 64 and a shape of a plate extending to the rear of the grille cover 300.

For example, the first front surface air guide 130 may extend even to a rear surface of the first condenser from the rear surface of the grille cover 300 so that a circulation flow for circulating the external air well inside the first machine room 100 while effectively dissipating the first condenser 110.

However, the present disclosure is not limited thereto, and the first front surface air guide 130 may extend longer or shorter with respect to the rear surface of the first condenser 110.

The first front surface air guide 130 may be formed to have a first flat surface 131 extending in the front-rear direction, and may guide the circulation of external air to guide the circulation of the external air flowing between the first front surface air guide 130 and the support portion 64.

A first bent portion 132 may be formed at an upper end of the first flat surface 131 of the first front surface air guide 130, and may provide a bent surface to support the lower surface of the second inner case 10*b*, thereby dispersing the load of the large-sized refrigerator 1.

The first partition portion 301 may extend rearward to contact the front surface of the first front surface air guide 130 disposed in the rear.

For example, the rear surface of the first partition portion 301 may contact the front surface of the first front surface air guide 130.

As described above, since the rear surface of the first partition portion 301 may contact the front surface of the first front surface air guide 130 so that the external air introduced though the air inlet 330 may flow to the first compressor 120 after passing through the first condenser 110, without leaking between the first front surface air guide 130 and the first partition portion 301.

A first surface side air guide 151 behind the first compressor 120 may be disposed at a corner between the support portion 64 and the rear surface 100*b* of the first machine room 100.

The first rear surface one side air guide 151 may have a height equal or similar to the support portion 64 in the up-down direction.

One side of the first rear surface one side air guide 151 may be fixed to the support portion 64, and the other side thereof may be fixed to the rear surface 100*b* of the first machine room 100, to be disposed in a diagonal direction face the first compressor 120.

In this case, the first rear surface one side air guide 151 may be formed to have a curved portion convex toward the corner, so that the flow direction of the external air having passed through the first compressor 120 can be switched toward the outer lateral surface 100*s* of the first machine room 100 by the first rear surface one side air guide 151.

A first rear surface other side air guide 152 behind the first compressor 120 may be disposed at a corner between the outer lateral surface 100*s* of the first machine room 100 and the rear surface 100*b* of the first machine room 100.

The first rear surface other side air guide 152 may have a height equal or similar to the support portion 64 in the up-down direction.

One side of the first rear surface other side air guide 152 may be fixed to the outer lateral surface 100*s* of the first machine room 100, and the other side thereof may be fixed to the rear surface 100*b* of the first machine room 100, to be disposed in a diagonal direction face the first condenser 110.

In this case, the first rear surface other side air guide 152 may be formed to have a curved portion convex toward the corner so that the flow direction of the external air having been switched toward the outer lateral surface 100*s* of the first machine room 100 can be switched again toward the outer lateral surface 100*s* of the first machine room 100.

Since the first compressor 120 and the first condenser 110 are positioned adjacent to the support portion 64, the first compressor 120 may be disposed closer to the first rear surface one side air guide 151 than the first rear surface other side air guide 152.

Accordingly, the first rear surface other side guide 152 is disposed in the diagonal direction to face the first condenser 110 not the first compressor 120, thereby inducing a natural external air flow as close to symmetry as possible with respect to the left-right direction of the first machine room 100.

However, the present disclosure is not limited thereto, and the first rear surface other side air guide 152 may be disposed in the diagonal direction to face the first compressor.

The external air flowing along the circulation direction switched by the first rear surface other side air guide 152 may pass between the outer lateral surface 100*s* of the first machine room 100 and the first front surface air guide 130 to be discharged to the outside via a first air outlet 310 of the grille cover 300.

Accordingly, the first air outlet 310 may be formed between the outer surface 100*s* of the first machine room 100 and the first partition portion 301, or between the first lateral surface finishing portion 341 and the first partition portion 301.

As described above, the external air circulating inside the first machine room 100 may be introduced through the air inlet 330 and circulated inside the first machine room 100 along a first circulation path 410 to be discharged through the first air outlet 310.

An auxiliary air guide 133 may be disposed between the first blower fan module 111 and the support portion 64.

As described above, the support portion 64 may be disposed more adjacent to the second machine room 200 than the center line 65 with respect to the left-right direction of the machine room 60.

Accordingly, a predetermined space may be formed between the first blower fan module 111 and the support portion 64. The auxiliary air guide 133 may be formed in the space formed between the first blower fan module 111 and the support portion 64 to extend in the left-right direction.

The auxiliary air guide 133 may have a height equal or similar to the support portion 64.

In addition, one side of the auxiliary air guide 133 may be disposed in contact with or so close to one side of the first blower fan module 111. The other side of the auxiliary air guide 133 may be disposed in contact with or so close to one side of the support portion 64.

An upper surface of the auxiliary air guide 133 may become a support surface for supporting the lower surface of the second inner case 10*b*.

Since the auxiliary air guide 133 is disposed between the first blower fan module 111 and the support portion 64 as described above, the external air introduced through the air inlet 330 may be prevented from leaking through the space between the first blower fan module 11 and the support portion 64, so that it may intensively pass through the first condenser 110 as much as possible.

A first defrost water tray 140 and a first defrost water outlet hole 160 may be disposed between the outer surface 100*s* of the first machine room 100 and the first front surface air guide 130.

In other words, the first defrost water tray 140 may be disposed behind the first air outlet 310.

For example, an evaporator may be disposed in the storage compartment 51 and 52. When a defrosting process is performed, there might be defrost water in the space where the evaporator or the evaporator is disposed.

The generated defrost water may be discharged to the first defrost water tray 140 through the first defrost water outlet hole 160, and the first defrost water tray 140 may store the defrost generated as described.

The first defrost water tray 140 may be formed in a shape of a plate having a storage space for storing a predetermined amount of defrost water sufficiently, but the present disclosure is not limited thereto.

The first defrost water tray 140 may be formed to have a storage space with an open top surface so that the defrost water stored in the first defrost water tray 140 may be evaporated.

An evaporation surface area may be increased so as to make it easy to evaporate the evaporation of the defrost water stored in the first defrost water tray 140.

Accordingly, the first defrost water tray 140 may longitudinally extend in the front-rear direction to have the maximized large area but may have a low height.

For example, the first defrost water tray 140 may have a length extending in the front-rear direction to overlap predetermined areas of the first compressor 120, the first blower fan module 111 and the first condenser 110, but the present disclosure is not limited thereto.

External air circulating through the first circulation path 410 may pass through an upper area of the first defrost water tray 140.

The external air passing through the upper area of the first defrost water tray 140 may have a temperature increasing while it is passing through the first condenser 110 and the first compressor 120, and may be discharged to the outside through the first air outlet 310. Due to the flow of the external air and the increased temperature of the external air, the defrost water of the first defrost water tray 140 may be effectively evaporated.

Especially, since the first defrost water tray 140 longitudinally extending in the front-rear direction may have an increased time of contacting the discharged external air, the defrost water can be evaporated more effectively.

Meanwhile, a first valve 170 may be disposed between the first defrost water tray 140 and the outer lateral surface 100*s* of the first machine room 100.

The first valve 170 may be a 3-way valve that controls the flow of the refrigerant to the plurality of evaporators after passing through the condenser, but the present disclosure is not limited thereto.

As described above, the first valve 170 may be disposed between the first defrost water tray 140 and the outer lateral surface 100*s* of the first machine room 100. Due to this structure, it is possible to provide the arrangement structure of the components disposed in the machine room configured not to interfere with the external air flowing along the first circulation path 410 in the order of the first condenser 110, the first compressor 120 and the first defrost water tray 140 as much as possible.

Meanwhile, a second condenser 210, a second blower fan module 211 and a second compressor 220 may be sequentially disposed in the second machine room 200 from the front to the rear with respect to the rear surface of the grille cover 300.

The second condenser 210, the second blower fan module 211 and the second compressor 220 may be disposed on the lower surface 60*e* of the machine room 60.

In this instance, a second base plate 280 may be disposed on the lower surface 60*e* of the second machine room 200.

Accordingly, the second condenser 210, the second blower fan module 211 and the second condenser 220 may be fixed to the second base plate 280.

The second base plate 280 may be pulled out forward in a state where the grille cover 300 is removed, so the internal components of the second machine room 200 can be easily repaired.

Accordingly, when the second base plate 280 is pulled out to the front surface, the second condenser 210, the second blower fan module 211 and the second compressor 220, which are disposed on the second base plate 180, may be moved out to the font direction.

The second condenser 210 and the second blower fan module 211 may be coupled to a second guide fan 202. The second guide fan 202, the second condenser 210 and the second blower fan module 211 may form a second guide fan unit 72.

Accordingly, the second condenser 210 and the second blower fan module 211 coupled to the second guide fan 202 may be fixed on the second base plate 280 as the second guide fan unit 72.

A plurality of second fixing portions 221 may be formed in the second compressor 220 to provide a stronger fixing force and reduce vibration, thereby fixing the second compressor 220 on the second base plate 280. However, the fixing form is not specifically limited.

The second condenser 210, the second blower fan module 211 and the second compressor 220 may be disposed side by side in one direction to overlap each other with respect to the front-rear direction.

The second condenser 210, the second blower fan module 211 and the second compressor 220 may be disposed adjacent to the support portion 64 with respect to the left-right direction of the second machine room 200.

When the second blower fan module 211 is operated, external air 67 may be introduced into the second machine room 200 in a direction adjacent to the support portion 64 with respect to the left-right direction of the second machine room 200.

Accordingly, the external air 67 introduced from the grille cover 300 disposed in the front portion may dissipate the second condenser 210 and then pass through the second blower fan module 211 sequentially to cool the second compressor 220.

The area in which the external air 67 is introduced through the grille cover 300 may be defined as an air inlet 330.

The air inlet 330 of the second machine room 200 may be formed between the second partition portion 302 and the support portion 64.

In order to induce the external air introduction through the air inlet 330, a second front surface air guide 230 may be disposed in a rear area of the second partition portion 302.

The second front surface air guide 230 may be disposed so that the second condenser 210, the second blower fan module 211 and the second compressor 220 may be disposed between the second front surface air guide 230 and the support portion 64.

The first front surface air guide 230 may be formed to have a height equal or similar to the support portion 64 and a shape of a plate extending to the rear of the grille cover 300.

For example, the second front surface air guide 230 may extend even to a rear surface of the second condenser 210 from the rear surface of the grille cover 300 so that a circulation flow for circulating the external air well inside the second machine room 200 while effectively dissipating the second condenser 210.

However, the present disclosure is not limited thereto, and the second front surface air guide 230 may extend longer or shorter with respect to the rear surface of the second condenser 210.

The second front surface air guide 230 may be formed to have a second flat surface 231 extending in the front-rear direction, and may guide the circulation of external air to guide the circulation of the external air flowing between the second front surface air guide 230 and the support portion 64.

A second bent portion 232 may be formed at an upper end of the second flat surface 231 of the second front surface air guide 230, and may provide a bent surface to support the lower surface of the second inner case 10*b*, thereby dispersing the load of the large-sized refrigerator 1.

The second partition portion 302 may extend rearward to contact the front surface of the second front surface air guide 230 disposed in the rear.

For example, the rear surface of the second partition portion 302 may contact the front surface of the second front surface air guide 230.

As described above, since the rear surface of the second partition portion 302 may contact the front surface of the second front surface air guide 230 so that the external air introduced though the air inlet 330 may flow to the second compressor 220 after passing through the second condenser 110, without leaking between the second front surface air guide 230 and the second partition portion 302.

A second surface one side air guide 251 behind the second compressor 220 may be disposed at a corner between the support portion 64 and the rear surface 200*b* of the second machine room 200.

The second rear surface one side air guide 251 may have a height equal or similar to the support portion 64 in the up-down direction.

One side of the second rear surface one side air guide 251 may be fixed to the support portion 64, and the other side thereof may be fixed to the rear surface 200*b* of the second machine room 200, to be disposed in a diagonal direction face the second compressor 220.

In this case, the second rear surface one side air guide 251 may be formed to have a curved portion convex toward the corner, so that the flow direction of the external air having passed through the second compressor 220 can be switched toward the outer lateral surface 200*s* of the second machine room 200 by the second rear surface one side air guide 251.

A second defrost water tray 240 may be disposed between the outer surface 200*s* of the second machine room 200 and the second condenser 210 and the second compressor 220.

Accordingly, the second condenser 210 and the second compressor 220 may be disposed in one side of the second defrost water tray 240.

A second rear surface other side air guide 252 extending along a longitudinal direction, which is the front-rear direction of the second defrost water tray 240, may be disposed in the other side of the second defrost tray 240.

The second rear surface other side air guide 252 may have a height equal or similar to the support portion 64 in the up-down direction.

The rear surface of the second rear surface other side air guide 252 may be fixed to the rear surface 200*b* of the second machine room 200.

The second rear surface other side air guide 252 may be formed to extend as approximately half of the front-rear direction length of the second defrost water tray 240, but the present disclosure is not limited thereto.

The second rear surface other side air guide 252 disposed between the second defrost water tray 240 and the outer lateral surface 200*s* of the second machine room 200 may be as close to the second defrost water tray 240 as possible.

One side of the second rear surface other side air guide 252 facing the other side of the second defrost water tray 240 may extend in the front-rear direction as much as the second defrost water tray 240 extends in the front-rear direction, while it has a flat portion.

The second rear surface other air guide 252 may have a predetermined width in the left-right direction, and an empty space therein. Components such as a noise filter printed circuit board PCB may be stored in the empty space formed therein, only to improve spatial utilization inside the second machine room 200.

Due to the shape of the second rear surface other side guide 252, the external air of which the flow direction is switched to the outer lateral surface 200*s* of the second machine room 200 by the second rear surface one side air guide 251, may flow again to the front of the machine room 60, where the grille cover 300 is provided, in a re-switched flow direction.

The external air of which the circulation direction is switched by the second rear surface other side air guide 252 may pass between the outer lateral surface 200*s* of the second machine room 200 and the second front surface air guide 230, to be discharged to the outside via the second air outlet 320 of the grille cover 300.

Accordingly, the second air outlet 320 may be formed between the outer surface 200*s* of the second machine room 200 and the second partition portion 302 or between the second lateral surface finishing portion 342 and the second partition portion 302.

As described above, the external air circulating inside the second machine room 200 may be introduced through the air inlet 330 and discharged through a second air outlet 320, and then may circulate the second machine room 200 along a second circulation path 420.

As described above, the second defrost water tray 240 may be disposed between the outer lateral surface 200*s* of the second machine room 200 and the second front surface air guide 230, and a second defrost outlet hole 260 may be further provided.

In other words, the second defrost water tray 240 may be disposed behind the second air outlet 320.

For example, an evaporator may be disposed in the storage compartment 51 and 52. When a defrosting process is performed, there might be defrost water in the space where the evaporator or the evaporator is disposed.

The generated defrost water may be discharged to the second defrost water tray 240 through the second defrost water outlet hole 260, and the second defrost water tray 240 may store the defrost generated as described.

The second defrost water tray 240 may be formed in a shape of a plate having a storage space for storing a predetermined amount of defrost water sufficiently, but the present disclosure is not limited thereto.

The second defrost water tray 240 may be formed to have a storage space with an open top surface so that the defrost water stored in the second defrost water tray 240 may be evaporated.

An evaporation surface area may be increased so as to make it easy to evaporate the evaporation of the defrost water stored in the second defrost water tray 140.

Accordingly, the second defrost water tray 240 may longitudinally extend in the front-rear direction to have the maximized large area but may have a low height.

For example, the second defrost water tray 240 may have a length extending in the front-rear direction to overlap predetermined areas of the second compressor 220, the second blower fan module 211 and the second condenser 210, but the present disclosure is not limited thereto.

External air circulating through the second circulation path 420 may pass through an upper area of the second defrost water tray 240.

The external air passing through the upper area of the second defrost water tray 240 may have a temperature increasing while it is passing through the second condenser 210 and the second compressor 220, and may be discharged to the outside through the second air outlet 320. Due to the flow of the external air and the increased temperature of the external air, the defrost water of the second defrost water tray 240 may be effectively evaporated.

Especially, since the second defrost water tray 240 longitudinally extending in the front-rear direction may have an increased time of contacting the discharged external air, the defrost water can be evaporated more effectively.

Meanwhile, the second machine room 200 may be in communication with the refrigerator compartment, and the defrost water generated in the refrigerator compartment may be discharged and stored in the second defrost water tray 240.

Since the amount of defrost water generated in the refrigerator compartment is greater than that of the freezer compartment, the evaporation efficiency of the defrost water in the second machine room 200 interlocked with the refrigerator compartment may be set to increase more than the first machine room 100 interlocked with the freezer compartment.

Accordingly, in the machine room 200, the second rear surface other side air guide 252 may be disposed very closely along the other side of the second defrost water tray 240, so the external air discharged to the outside along the second circulation path 420 may be induced to intensively pass through the upper area of the second defrost water tray 240.

The second machine room 200 may evaporate the defrost water of the second defrost water tray 240 more quickly and efficiently, compared to the first machine room 100 in which the first rear surface other side air guide 152 is provided at the corner between the rear surface 100*b* and the outer lateral surface 100*s* thereof.

In addition, since the support portion 64 is disposed closer to the outer lateral surface 200*s* of the second machine room 200 than the center line 65 with respect to the left-right direction of the machine room 60 as described above, the left-right width of the second machine room 200 may be set smaller than the that of the first machine room 100.

As the left-right width of the second machine room 200 is set smaller than that of the first machine room 100, the area of the air inlet 330 corresponding to the second machine room 200 may be set smaller than the area of the air inlet 330 corresponding to the first machine room 100.

Accordingly, since the external air introduced through the air inlet 330 corresponding to the second machine room 200 may have a suction pressure higher than the external air introduced through the air inlet 330 corresponding to the first machine room 100, the flow rate of the external air in the second machine room 200 can become faster.

Then, as the flow rate of the external air in the second machine room 200 becomes faster as described above, the second machine room 200 may evaporate the defrost water of the second defrost water tray 240 more quickly and efficiently than the first machine room 100.

Meanwhile, a second valve 270 may be disposed between the second defrost water tray 240 and the outer lateral surface 200*s* of the second machine room 200.

The second valve 270 may be a water valve capable of supplying water to an icemaker or dispenser, but the present disclosure is not limited thereto.

As described above, the second valve 270 may be disposed between the second defrost water tray 240 and the outer lateral surface 200*s* of the second machine room 200. Due to this structure, it is possible to provide the arrangement structure of the components disposed in the machine room configured not to interfere with the external air flowing along the second circulation path 420 in the order of the second condenser 210, the second compressor 220 and the second defrost water tray 240 as much as possible.

As described above, the grille cover 300 may include the air inlet 330 for introducing external air into the machine room 60; and a first air outlet 310 and a second air outlet 320 that are disposed on both sides of the air inlet 330, respectively.

The air inlet 330 may be shared by the first machine room 100 and the second machine room 200, but the external air sucked into the machine room 60 may be divided by the support portion 64, which is a boundary between the first machine room 100 and the second machine room 200, to be sucked thereto.

The first air outlet 310 and the air inlet 330 may be divided by the first partition portion 301, and the first partition portion 301 may serve as a separation wall for separating the inflow and outflow of external air and a boundary wall.

In addition, the second air outlet 320 and the air inlet 330 may be divided by the second partition portion 302, and the second partition portion 302 may serve as a separation wall for separating the inflow and outflow of external air and a boundary wall.

The air inlet 330 may be disposed in a center area 63 of the machine room 60 including the boundary surface between the first machine room 100 and the second machine room 200. The first air outlet 310 may be disposed in a first lateral surface area 61 of the machine room including the outer lateral surface 100*s* of the first machine room 100. The second air outlet 320 may be disposed in a second lateral surface area 62 of the machine room 60 including the outer lateral surface 200*s* of the second machine room 200.

Accordingly, the external air sucked into the first machine room 100 through the air inlet 330 and discharged through the first air outlet 310 may be introduced into the center area 63 of the machine room 60 and then discharged to the first lateral surface area 61.

Then, the first circulation path 410 may circulate the first machine room 100 in a counter-clockwise direction to be sucked into the center area 63 of the machine room 60 and discharged to the first lateral surface area 61.

In addition, the external air sucked into the second machine room 200 through the air inlet 330 and discharged through the second air outlet 320 may be introduced into the center area 63 of the machine room 60 and discharged to the second lateral surface area 62.

Accordingly, the second circulation path 420 may circulate the second machine room 200 in a clockwise direction to be sucked into the center area 63 of the machine room 60 and discharged to the second lateral surface area 62.

Due to this structure, the air circulation direction of the first circulation path 410 may be opposite to that of the second circulation path 420.

The left-right width of the first lateral surface area 61 may be substantially the same as that of the second lateral surface area 62. The left-right width of the center area 63 may be substantially the same as the sum of the left-right widths of the first lateral surface area 61 and the second lateral surface area 62.

Accordingly, in the refrigerator of the present disclosure, the overall suction and discharge ratio of external air through the grille cover 300 may be set to be close to 1:1, thereby obtaining a further improved heat dissipation effect due to the drastically increased suction rate of external air.

In addition, in the refrigerator 1 according to the present disclosure, the condenser 110 and the first compressor 120 of the first machine room 100 and the second condenser 210 and the second compressor 220 of the second machine room 200 are disposed adjacent to the support portion 64, so the first air outlet 310 of the first machine room 100 and the second air outlet 320 of the second machine room 200 may be spaced as far as possible from each other on both sides of the air outlet 320 shared by the first machine room 100 and the second machine room 200.

Accordingly, by minimizing interference between air circulation paths that might occur between the air circulation cycles of the first circulation path 410 of the first machine room 100 and the second circulation path 420 of the second machine room 200, the heat dissipation performance and efficiency of the machine room may be improved.

Figure 5:
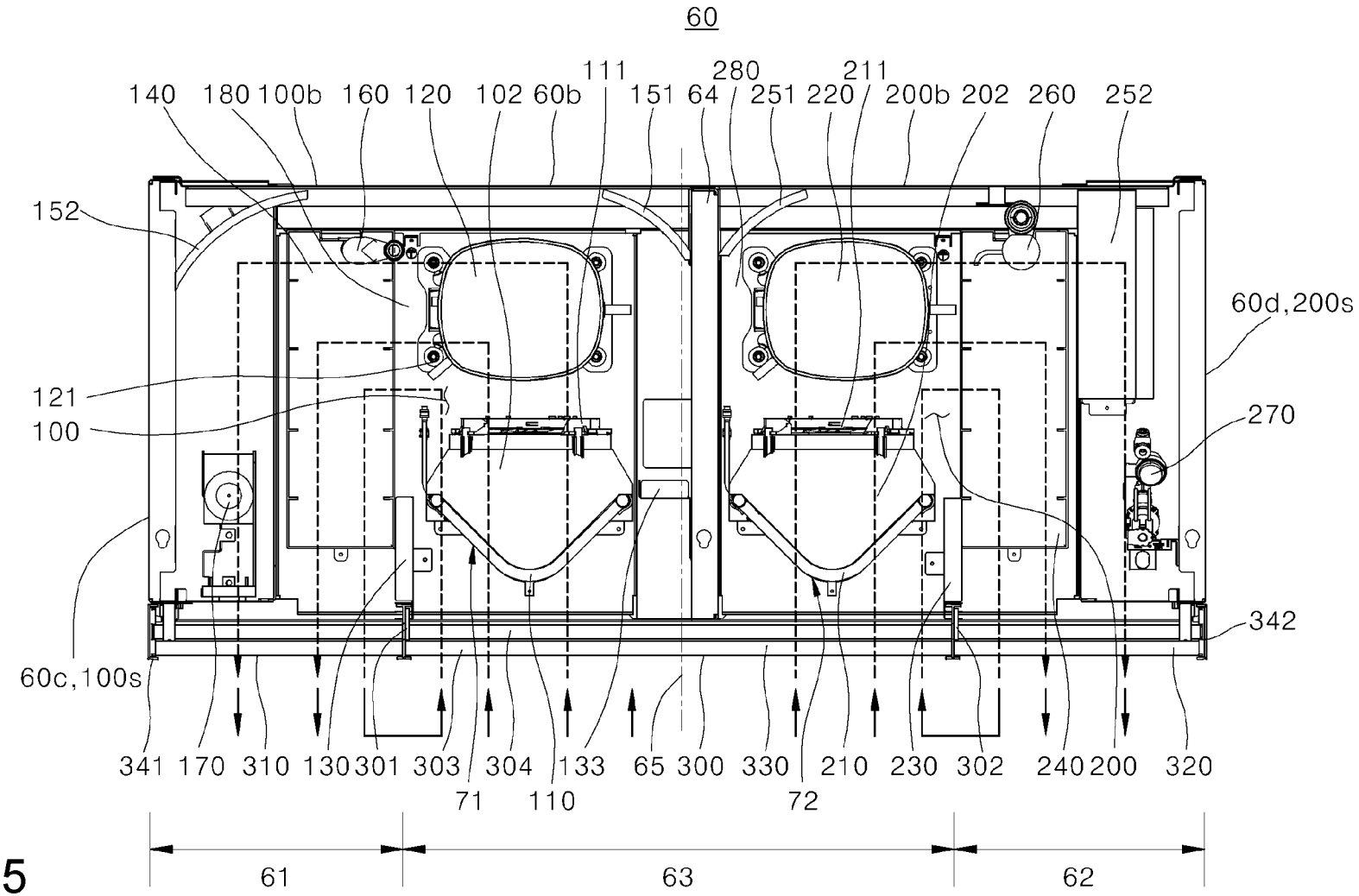
FIG. 5 is a plan view showing introducing, discharging and re-introducing of air through a first circulation path and a second circulation path of a machine room.

Referring to FIG. 5, some of the external air discharged through the first air outlet 310 of the first machine room 100 may be re-introduced into the first machine room 100 through the air inlet 330 near the first partition portion 301, which is the boundary surface between the first air outlet 310 and the air inlet 330.

Some of the external air discharged through the second air outlet 320 of the second machine room 200 may be re-introduced into the second machine room 200 through the air inlet 330 near the second partition portion 302 which is the boundary surface between the second air outlet 320 and the air inlet 330.

As described above, the re-introduction of external air may occur on the boundary surface between the air inlet 330 and the first air outlet 310 and the boundary surface between the air inlet 330 and the second air outlet 320.

When a large amount of re-introduced air occurs, the heat dissipation effect of the machine room 60 might decrease.

However, in the refrigerator 1 according to the present disclosure, the first air outlet 310 of the first machine room 100 and the second air outlet 320 of the second machine room 200 are arranged on both sides with respect to the air inlet 330 shared by the first machine room 100 and the second machine room 200. Accordingly, two boundary surfaces between the air inlet 330 and the air outlet are formed, to minimize the boundary surfaces and arranged the boundary surfaces to be spaced as far as possible.

Therefore, it is possible to increase the heat dissipation performance and efficiency of the machine room by increasing the ratio of external air introduced into the machine room and reducing the ratio of air immediately re-introduced after discharged from the machine room.

Figure 6:
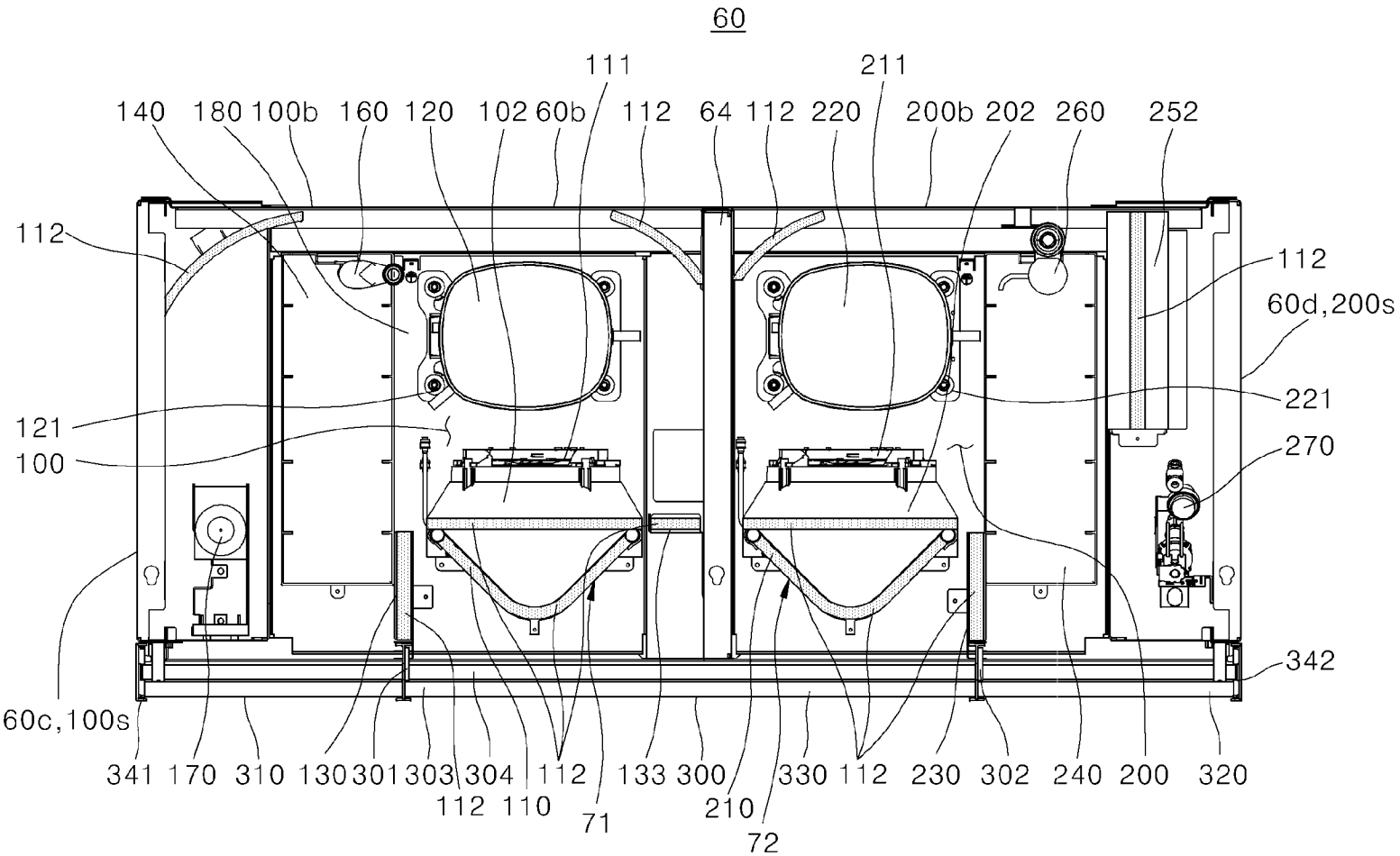
FIG. 6 is a plan view showing a machine room in which a gasket foam is additionally disposed on some components.

Meanwhile, referring to FIGS. 6 and 7, a gasket foam 112 may be further formed to surround an upper surface and a lateral surface of the first blower fan module 111 of the first machine room 100.

In addition, a gasket foam 112 may be formed along an upper surface of the first condenser 110.

Since the gasket foam 112 formed as described above may be filled in the space between the lower surface of the second inner case 10*b* and the first blower fan module 111, external air may be reduced from leaking through the space and the external air suction efficiency may be increased.

The gasket foam 112 may be also formed on upper surfaces of the first rear surface one side air guide 151, the first rear surface other side air guide 152, the first front surface air guide and the auxiliary air guide 133. Accordingly, the space between the lower surface of the second inner case 10*b* and each of the components may be filled and external air may be reduced from leaking through the space, to further improve the external air suction efficiency.

In addition, the gasket foam 112 formed on the lateral surface of the first blower fan module 111 may fill the space between the auxiliary air guide 133 and the lateral surface, to further improve the external air suction efficiency.

The gasket foam 112 may be additionally formed to surround an upper surface and a lateral surface of the second blower fan module 211 of the second machine room 200.

In addition, the gasket foam 112 may be formed along an upper surface of the first condenser 110.

Since the gasket foam 112 formed as described above may be filled in the space between the lower surface of the second inner case 10*b* and the first blower fan module 111, external air may be reduced from leaking through the space and the external air suction efficiency may be increased.

The gasket foam 112 may be also formed on upper surfaces of the first rear surface one side air guide 151, the first rear surface other side air guide 152, the first front surface air guide and the auxiliary air guide 133. Accordingly, the space between the lower surface of the second inner case 10*b* and each of the components may be filled and external air may be reduced from leaking through the space, to further improve the external air suction efficiency.

In addition, the gasket foam 112 formed on the lateral surface of the first blower fan module 111 may fill the space between the auxiliary air guide 133 and the lateral surface, to further improve the external air suction efficiency.

Hereinafter, referring to FIGS. 8 to 16, the guide fan unit 70 according to the present disclosure will be described in detail.

The guide fan unit 70 will be described under assumption that a front surface and forward direction of the guide fan unit 70 which will be described below means a direction in which external air is introduced into the guide fan unit 70, and a rear surface or rearward direction of the guide fan unit 70 means a direction in which external air is discharged from the guide fan unit 70.

The guide fan unit 70 may include a condenser 500, a blower fan module 600 blowing external air to pass through the condenser 500, and a guide fan 700 to which the condenser 500 and the blower fan module 600 are fixed.

The condenser 500 may include a first header 510 extending the up-down direction; a second header 520 also extending in the up-down direction; and a plurality of tubes 530 disposed in the up-down direction, spaced apart from each other, and connecting the first header 510 and the second header 520.

The first header 510 and the second header 520 may be disposed on both sides with respect to the guide fan 700, spaced a preset distance apart from each other, and may longitudinally extend in the up-down direction with the same height.

The first header 510 and the second header 520 may be connected to both ends of the tubes 530, respectively.

Partition walls may be formed in the first header and the second header 510 and 520, respectively, and may determine a flow path of refrigerant flowing along the plurality of connected tubes 530.

A refrigerant inlet pipe 511 for supplying refrigerant to the condenser 500 may be connected to an upper portion of the first header 510. A refrigerant outlet pipe 512 for discharging the refrigerant from the condenser 500 may be connected to a lower portion thereof.

The high-temperature-high-pressure refrigerant introduced through the refrigerant inlet pipe 511 may pass through the plurality of tubes 530 through the first header 510 to flow to the second header 520.

Hence, the refrigerant flowing into the second header 520 may be switched in flow direction by the second header 520, passes through a plurality of other tubes 530, and flows to the first header 510, so it may finally be discharged through the refrigerant outlet pipe 512.

One tube 530 may be formed in a structure in which a plurality of channels or paths are continuously arranged in a horizontal direction, and may have both ends that connect the first header 510 and the second header 520.

For example, one tube 530 may be formed to have a V-shape as a whole.

One end of the tube 530 connected with the first header 510 may have a first extension 531 extending in a straight line. The other end of the tube 530 connected with the first header 510 may have a second extension 532 extending in a straight line. A bent portion 533 bent in one direction may be formed between the first extension 531 and the second extension 532.

The bent portion 533 may be bent to protrude in a curved shape toward the direction in which external air is introduced.

Accordingly, the first extension 531 and the second extension 532 may be disposed in a diagonal direction of the direction in which the external air is introduced.

The tube 530 may have a shape in which the first extension 531 and the second extension 532 are symmetrical to each other with respect to the bent portion 533.

The plurality of tubes 530 may be formed with the same structure and shape as each other, and may be continuously arranged at regular intervals in the up-down direction along the first header 510 and the second header 520.

In this way, the tubes 530 of the condenser 500 may have the bent portion 533 protruding in the direction in which the external air is introduced, and the first extension 531 and the second extension 532 may be disposed in the diagonal direction.

The shape of the tube 530 of the condenser 500 may increase the contact area between the tubes 530 and the external air while occupying as little volume as possible inside the machine room 60, thereby increasing both space efficiency and heat exchange efficiency of the condenser 500.

A heat exchange fin 540 may be provided in a space between the plurality of tubes 530.

The heat exchange fin 540 may be formed along the space between the plurality of tubes 530, while being continuously bent in a zigzag shape.

A plurality of fin openings 541 may be formed between a bent portion of the heat exchange fin 540 and the tubes 530 by coupling the heat exchange fin 540 to the tubes.

Accordingly, a contact area of air passing through the fin openings 541 formed by the heat exchange fin 540 may be increased so that heat exchange efficiency with refrigerant inside the tubes 530 may be further increased.

In some drawings, of the present disclosure, the heat exchange fin 540 is removed from the condenser 500 for convenience of description.

The blower fan module 600 may include a blower fan 610 configured to blow air; a fan motor 620 configured to rotate the blower fan 610 by providing a driving force to the blower fan 610; and a frame 630 supporting the blower fan 610 and the fan motor 620.

For example, the frame 630 may be formed in a circular shape having a hollow therein, but the present disclosure is not limited thereto.

A coupling structure is formed in a center area of the frame 630 to be coupled to the fan motor 620, thereby a shaft of the fan motor 620 may be provided.

A plurality of coupling members 631 may be disposed along an edge of the frame 630.

For example, the coupling member 631 may be a screw and the blower fan module 600 may be coupled to the guide fan 700 by the coupling member 631.

The guide fan 700 may include a first mounting portion to which the condenser 500 is secured; and a second mounting portion 720 to which the blower fan module 600 is secured.

The condenser 500 and the blower fan module 600 may be arranged side by side in the front-rear direction along the indirection in which the external air is introduced. The blower fan module 600 may be disposed to face the condenser 500 so that the external air blown by the driving of the blower fan 610 may pass through the condenser 500.

Accordingly, the first mounting portion 710 to which the condenser 600 is secured may be disposed in front closer to the inflow direction of external air than the second mounting portion 720 to which the blower fan module 600 is secured.

The first mounting portion 710 may include a first holder 711 and a second holder 712 for fixing one side and the other side of the condenser 500, respectively.

The first holder 711 and the second holder 712 may be disposed on both sides with respect to a shaft of the fan motor 620.

In this instance, in order to minimize interference of external air flow by the blower fan 610, the first holder 711 and the second holder 712 may be located both outer areas of the blower fan 610 not to overlap the blower fan 610 in the front-rear direction.

The first holder 711 and the second holder 712 may be formed to have open tops so that the condenser can be insertedly coupled in the up-down direction.

Accordingly, a predetermined lower area of the first header 510 extending in the vertical direction may be insertedly fixed to the first holder 711. A predetermined lower area of the second header 520 extending in the vertical direction may be insertedly fixed to the second header 520.

Specifically, the first holder 711 may have a shape corresponding to the first header 510 to surround the first header 510.

For example, the first header 510 may be formed in a cylindrical shape, and the inner diameter of the first holder 711 may be formed in a shape corresponding to the cylindrical shape.

The first holder 711 may include a first opening 7111 penetrated by the first extension 531.

Since the first extension 531 of the tube 530 is connected to one side of the first header 510, the first extensions of the tubes 530 may be insertedly fixed through the first opening 7111 formed in the first holder 711.

Accordingly, the first opening 7111 may be formed as a continuous opening along one side of the first header 510 in an upward and downward direction to allow the plurality of tubes 530 to be inserted.

In this case, one side of the first header 510 may have a pair of outwardly extending first guides 7113 formed to guide the insertion direction and fixing position of the first extension 531.

The pair of first guides 7113 may have a shape extending to surround both sides of the first extension 531, and the first opening 7111 may be continuously formed between the pair of first guides 7113 to fluidly communicate with the first holder 711.

A rear surface opening 7112 may be formed on the other side of the first holder 711 facing one side of the first holder 711 in which the first opening 7111 is formed.

The rear surface opening 7112 may be formed in a shape continuously open along the up-down direction of the other side of the first header 510 so that a refrigerant outlet pipe 512 may be inserted in the rear surface opening 7112.

The second holder 712 may have a shape corresponding to the second header 520 to surround the second header 520.

For example, the second header 520 may be formed in a cylindrical shape and an inner diameter of the second holder 712 may have a shape corresponding to the cylindrical shape.

The second holder 712 may include a second opening 7121 through which the second extension 532 passes.

Since the second extension 532 of the tube 530 is connected to one side of the second header 520, the second extensions 532 of the plurality of tubes 530 may be insertedly fixed through the second opening 7121 formed in the second holder 712.

Accordingly, the second opening 7121 may have a shape continuously open along the up-down direction of one side of the second header 520 so that the plurality of tubes 530 may be inserted in the second opening 7121.

In this case, a pair of second guides 7123 extending outward to guide the inserting direction and fixing position of the second extension 532 may be formed on one side of the second header 520.

The pair of second guides 7123 may have a shape extending to surround both sides of the second extension 532, and the second opening 7121 may be continuously formed between the pair of the second guides 7123 to fluidly communicate with the second holder 712.

The first holder 711 and the second holder 712 may be formed to surround outer surfaces of the first header 510 and the second header 520 to strongly restrict the motion in the horizontal direction of the first header 510 and the second header 520. Accordingly, the first opening 7111 and the second opening 7121 may have the minimum width so that the first extension 531 and the second extension 532 can pass through the first opening 7111 and the second opening 7121.

To this end, the first holder 711 and the second holder 712 may be disposed so that the first opening 7111 and the second opening 7121 may be toward the bent portions 533 of the tubes 530, That is, the first opening 7111 may be formed along the direction in which the first extension 531 extends. The second opening 7121 may be formed along the direction in which the second extension 532 extends. Accordingly, the first opening 7111 and the second opening 7121 may be also disposed toward the bent portions 533 formed in the area where the first extension 531 and the second extension 532 extend to cross each other.

Accordingly, since the first opening 7111 and the second opening 7121 have the least width for the first extension 531 and the second extension 532 to pass through the first opening 7111 and the second opening 7121, the first holder 711 and the second holder 712 may strongly restrict the horizontal-direction movement of the condenser 500.

A first support portion 731 supporting the lower surface of the first holder 711 and a second support portion 732 supporting the lower surface of the second holder 712 may be formed in the guide fan 700.

The first support portion 731 and the second support portion 732 may be formed to have a predetermined height and a predetermined width in the front-rear-and-left-right direction, to provide a supporting force for substantially supporting the condenser 500.

However, the heights of the first support portion 731 and the second support portion 732 may be equal to or lower than the height of the lower end of the blower fan 610 not to interfere with the flow of external air by the blower fan 610.

In addition, the first support portion 731 and the second support 732 may be formed to have a left-right direction width not to overlap the blower fan 610 in the front-rear direction. Accordingly, it is possible not to interfere with the external air flow by the blower fan 610.

A lower wall 740 having one end and the other end connected with the first support portion 731 and the second support portion 732 may be formed between the first support portion 731 and the second support portion.

The lower wall 740 may be formed in a shape corresponding to the tube 530 of the condenser 500 as a whole.

Accordingly, the lower wall 740 may include a first lower wall extension 741 extending from one side of the first support portion 731 along the first extension 531 of the tube 530; and a second lower wall extension 742 extending from one side of the second support portion 732 along the second extension 532 of the tube 530. A bent wall 743 may be formed between the first lower wall extension 741 and the second wall extension 742.

The bent wall 743 may have a shape corresponding to the bent portion 533 of the tube 530.

Since the bent wall 743 is bent to overlap the bent portion 533 in the up-down direction, the lower wall 740 may be bent at a position where the bent wall 743 is disposed, with a shape protruding in a direction in which external air is introduced.

Accordingly, the bent portion 533 of the tube 530 and the bent wall 743 of the lower wall 740 may be disposed to be spaced farther from the blower fan 610 than the first holder 711, the second holder 712, the first header 510 and the second header 520.

The lower wall 740 may have a predetermined height, and the height of the lower wall 740 may be the same as the first support portion 731 and the second support portion 732.

Accordingly, the height of the lower wall 740 may be equal to or lower than the height of the lowermost end of the blower fan 610 not to interfere with the external air flow by the blower fan 10.

A third support portion 733 protruding outward in the direction in which external air flows may be formed on the lower wall 740.

For example, the third support portion 733 may protrude outward from the bent wall 743, but the present disclosure is not limited thereto.

The third support portion 733 may be formed to have a height substantially the same as the lower wall 740, and a coupling hole 7331, to which a coupling member such as a screw is coupled in the up-down direction, may be formed on the third support portion 733.

A pair of guide fan fixing portions 744 may extend outward from outer lateral surfaces of the first support portion 731 and the second support portion 732, respectively.

In this instance, a guide fan fixing portion 744 extending outward from the first support portion 731 may also extend outward from the first lower wall extension 741. The guide fan fixing portion 744 extending outward from the second support portion 732 may extend outward from the second lower wall extension 742.

The guide fan fixing portion 744 formed as described above may include a coupling hole 7441 through which the guide fan fixing portion 744 is fixed to a bottom surface of the machine room 60 such as a first base plate 180 or a second base plate 280 by a coupling member such as a screw.

Meanwhile, a second mounting portion 720 including a ventilation hole 722 open toward the condenser 500 may be formed in the guide fan 700.

The second mounting portion 720 may be located behind the first mounting portion 710 to which the condenser 500 is secured.

the air ventilation hole 722, in which the blower fan 610 of the blower fan module 600 is disposed, may be open toward the condenser 500 so that external air can flow well into the condenser 500 located in front of the second mounting portion 720.

Accordingly, the rotation axis of the blower fan 610 may coincide with the central axis of the front-rear direction of the guide fan unit 70.

A corresponding structure, in which the frame 630 of the blower fan module 600 can be inserted and fixed, can be formed in the second mounting portion 720.

For example, a first circumferential portion 7221 surrounding the outer circumferential surface of the frame 630 and a second circumferential portion 7222 surrounding the inner circumferential surface of the frame 630 may be formed in the second mounting portion 720. A concave groove may be formed between the first circumference portion 7221 and the second circumference portion 7222 into which a predetermined portion of the frame 630 may be inserted and fixed.

Accordingly, the frame 630 may be inserted in the concave groove formed between the first circumferential portion 7221 and the second circumferential portion 7222 so that the insertion position and direction of the blower fan module 600 may be easily guided.

A plurality of frame fixing portions 723 may be formed in the second mounting portion 720 along the air ventilation hole 722.

For example, the plurality of frame fixing portions 723 spaced apart from each other along the outside of the first circumferential portion 7221 of the second mounting portion 720 may protrude rearward.

Coupling members 631 are disposed at positions on the frame 630 of the blower fan module 600, corresponding to the plurality of the frame fixing portions 723, respectively, to be coupled to the frame fixing portions 723.

Accordingly, the coupling member 631 may be coupled to the frame fixing portion 723 to pressurize the frame 630 of the blower fan module 600 forward, thereby fixing the blower fan module 600 to the second mounting portion 720.

Washers 632 may be disposed between the coupling member 631 and the frame 630 and between the frame 630 and the frame fixing portion 723, respectively.

In addition, a plurality of hooking protrusions are spaced apart from each other along the circumferential portion of the frame fixing portion 723, and may support the washer 623 disposed between the frame 530 and the frame fixing portion 723.

For example, the coupling member 631 may be a screw, but the present disclosure is not limited thereto.

In addition, the coupling member 631 may be separable from the frame 630, but the present disclosure is not limited thereto. The coupling member 631 may be integrally formed with the frame 630.

The blower fan 610 of the blower fan module 600 fixed as described above may be located in the air ventilation hole 722.

The second mounting portion 720 may include four surfaces in up, down, left, and right directions radially extending in a forward and outward direction where the condenser 500 is located with the air ventilation hole 722 as a center.

For example, a first surface 721*a* may extend the forward and outward direction from an upper area of the air ventilation hole 722. A second surface 721*b* and a third surface 721 may extend from both sides of the air ventilation hole 722 in the forward and outward direction. A fourth surface 721*d* may extend from a lower portion of the air ventilation hole 722 in the forward and outward direction.

Accordingly, the first surface 721*a*, the second surface 721*b*, the third surface 721*c* and the fourth surface 721*d* may be continuously connected with each other, and may have a shape surrounding the air ventilation hole 722 along a radial direction.

Accordingly, the air ventilation hole 722 may have a shape protruding rearward with respect to the first surface 721*a*, the second surface 721*b*, the third surface 721*c* and the fourth surface 721*d*.

A rear surface support 728 supporting a rear area of the guide fan unit 70 may be formed on the fourth surface 721*d* of the air ventilation hole 722.

For example, the rear surface support 728 may protrude rearward and downward from an outer surface of the first circumferential portion 7221 and the fourth surface 721*d*. A pair of rear surface supports 728 may be formed on both sides of the air ventilation air hole 722.

The rear surface support 728 formed as described above may intensively support the lower surface of the air ventilation hole 722 protruding rearward so that the support of the guide fan unit 70 may be balanced as a whole.

An upper surface extension 724 may extend from the upper end of the second mounting portion 720, that is, the first surface 721*a* of the second mounting portion 720 in a direction in which the condenser 500 is disposed.

The outer circumferential portion of the upper surface extension 724 may be formed along the shape of the tube 530.

Accordingly, the outer circumferential portion of the upper surface extension 724 may have a shape corresponding to the first extension 531, the bent portion 533 and the second extension 532 of the tube 530.

The upper surface extension 724 may have a shape with an overall area increasing toward the center from both sides.

In this instance, since the condenser 500 is inserted in the up-down direction as described above, the upper surface extension 724 may be spaced a preset distance apart from the tube 530 along the shape of the tube 530 not to interfere with the up-down insertion of the condenser 500.

The lower end extension 725 may extend from the lower end of the second mounting portion 720, that is, the four surface 721*d* of the second mounting portion 720 in the direction in which the condenser 500 in front is disposed.

The outer circumferential portion of the lower surface extension 725 may be formed along the shape of the tube 530.

Accordingly, the outer circumferential surface of the lower surface extension 725 may have a shape corresponding to the first extension 531, the bent portion 533 and the second extension 532 of the tube 530.

Accordingly, the lower surface extension 725 may be formed in a shape having an area increasing toward the center from both sides as a whole.

The first support portion 731, the second support portion 732 and the lower wall 740 may be disposed on the lower extension 725.

For example, the rear surface of the first support portion 731 may contact the first surface 721*c* and the lower surface of the first support portion 731 may contact the lower extension 725.

In this instance, the rear surface and the lower surface of the first support portion 731 may not be separate surfaces from the third surface 721*c* and the lower surface extension 725, and may be continuously formed to share the same surface.

In addition, the rear surface of the second support portion 732 may contact the second surface 721*b*, and the lower surface of the second support portion 732 may contact the lower surface extension 725.

In this instance, the rear surface and the lower surface of the second support portion 732 may not be separate surfaces from the second surface 721*b* and the lower surface extension 725, and may be continuously formed to share the same surface.

The outer circumferential portion of the lower surface extension 725 may coincide with the boundary portion of the lower wall 740.

As described above, the first support portion 731, the second support portion 732 and the lower wall 740 may be formed to have a predetermined height. The heights of the first support portion 731, the second support portion 732 and the lower wall 740 may be equal to or below the height of the lowest end of the air ventilation hole 722 so that the external air flow by the blower fan 610 can be smoothly performed.

A first lateral surface 726 may extend from the second surface 721*b* of the second mounting portion 720 in the direction in which the condenser 500 is located in front.

The first lateral surface 726 may vertically extend along the second surface 721*b*.

However, the first side surface 726 may be formed discontinuously so as to secure a space in which the refrigerant inlet pipe 511 and the refrigerant outlet pipe 512 of the first header 510 can pass through the first lateral surface 726 rearward.

In order not to interfere as much as possible with the first holder 711 located in the front, the first lateral surface 726 may extend to a line not exceeding the first holder 711, but the present disclosure is not limited thereto. The first holder 711 may extend to a line overlapping some area of the first holder 711.

A second lateral surface 727 may extend from the third surface 721*c* of the second mounting portion 720 in the direction in which the condenser 500 is disposed in front.

The second lateral surface 727 may continuously extend in the vertical direction along the third surface 721*c*.

In order not to interfere as much as possible with the second holder 712 located in the front, the second lateral surface 727 may extend to a line not exceeding the second holder 712, but the present disclosure is not limited thereto. The second holder 712 may extend to a line overlapping some area of the second holder 711.

The guide fan 700 described above may have a shape in which the first mounting portion 710 and the second mounting portion 720 are integrally formed as one body.

For example, the guide fan 700 including the first mounting portion 710 and the second mounting portion 720 may be formed by the same injection molding process using one mold.

That is, the guide fan according to the present disclosure includes the first mounting portion 710 for mounting the condenser 500 and the second mounting portion 720 for mounting the blower fan module 600, which are integrally formed as one body. Accordingly, compared to the structure in which the condenser 500 and the blower fan module 600 are assembled separately, the mounting position error of the condenser 500 and the blower fan module 600 may be reduced as much as possible and the number of assembly steps may be reduced, thereby securing high assembly reliability.

In addition, since the guide fan according to the present disclosure includes the first mounting portion 710 for mounting the condenser 500 and the second mounting portion 720 for mounting the blower fan module 600, which are integrally formed as one body, the guide fan may be realized with one mold and the efficiency of the process may be increased.

In this instance, to prevent interference between the mold core and the operating section for forming the air ventilation hole 722 of the second mounting portion 720 penetrating in the front-rear direction, the guide fan 700 according to the present disclosure may be the first holder 711 and the second holder 712 of the first mounting portion 710 are formed to be open upward so that the condenser 500 can be inserted in the up-down direction. Due to this structure, the guide fan 700 including the first mounting portion 710 and the second mounting portion 720 may be realized with one mold.

In the guide fan 700 according to the present disclosure, an upper surface extension 724 may extend from an upper end of the second mounting portion 720 in the direction in which the condenser 500 is disposed, so that a flow path guide structure for external air passing through the condenser 500 may be formed only by the shape of the structure itself of the guide fan 700.

Specifically, to allow the external air introduced from the front direction of the guide fan unit 70 to pass through the condenser 500 without bypassing the condenser as much as possible, the upper surface extension 724 may form an upper portion of the flow guide shaped structure. Accordingly, the external air may pass through the condenser 500 without being bypassed in the upper direction of the condenser 500 as much as possible.

In addition, the guide fan 700 according to the present disclosure, the lower wall 740 may be formed on the lower surface extension 725 of the guide fan 700. The flow path guide structure for external air passing through the condenser 500 may be formed only by the shape of the structure itself of the guide fan 700.

Specifically, to allow the external air introduced from the front direction of the guide fan unit 70 to pass through the condenser 500 without bypassing the condenser 500 as much as possible, the lower wall 740 may form the lower area of the flow path guide-shaped structure so that the external air may not bypass in the lower direction of the condenser 500 as much as possible but pass through the condenser 500.

The guide fan 700 according to the present disclosure may allow the air to pass through the condenser 500 due to the air flow path guide-shaped structure without bypassing as much as possible, to increase the heat dissipation performance of the condenser.

In addition, the guide fan 700 according to the present disclosure may be formed as an integrated type through the optimized mold design in which the condenser 500 and the blower fan module 600 can be fixed, together with the air flow path guide shaped structure. Accordingly, the guide fan may have an effect of requiring no additional member such as a separate lower plate or a cover plate.

Accordingly, such the guide fan unit 70 including the guide fan 700 in which the condenser 500 and the blower fan module 600 are mounted may have the air flow guide shaped structure as it is.

Due to this structure, may be provide the air flow path guide shaped structure with stability and high efficiency without limitation of shape of components such as the lower plate or the cover plate other than the guide fan unit 70 even in the inner space of the machine room, which is relatively narrow.

The guide fan unit 70 described above may be assembled through the following process.

However, the process which will be described below does not limit the process sequence, and the assembly sequence of each component may be changed.

Figure 12:
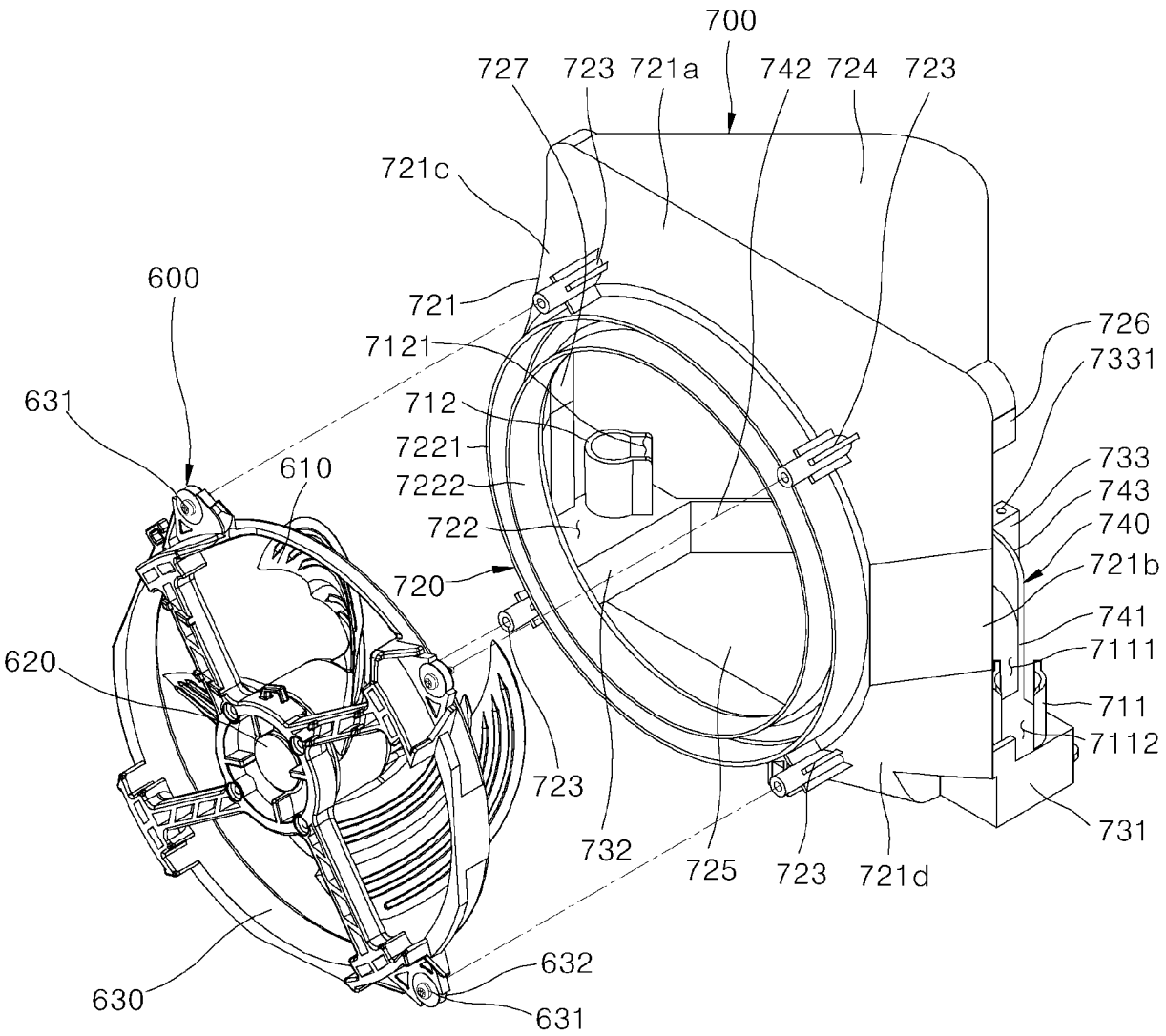
FIG. 12 is an exploded perspective view of a guide fan and a blower fan module.

Referring to FIG. 12, the blower fan module 600 may be coupled to the second mounting portion 729 of the guide fan 700 in the front-rear direction.

In this case, the blower fan module 600 may be coupled and fixed to the plurality of frame fixing portions 723 formed in the second mounting portion 720 by a coupling member 631.

Figure 13:
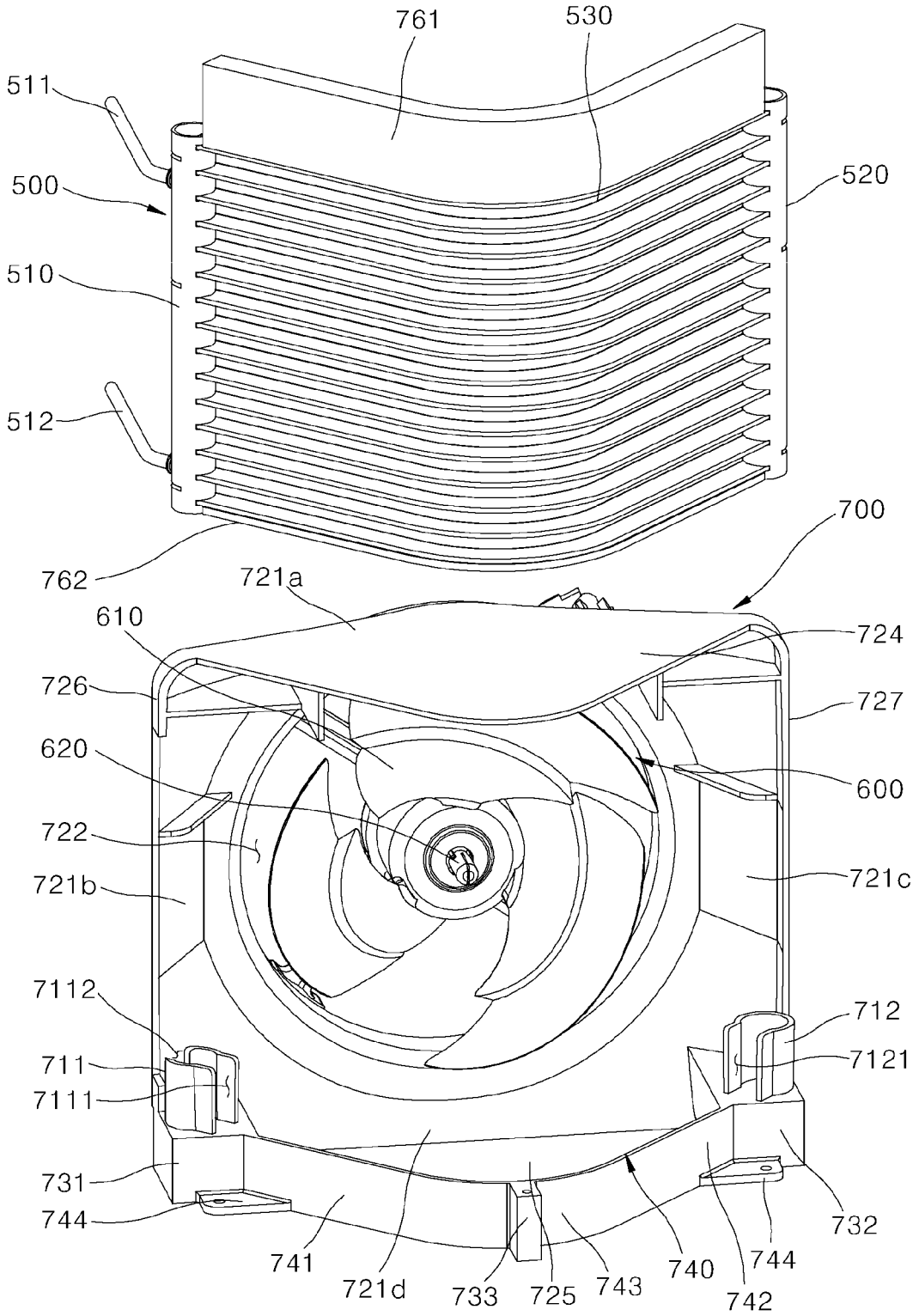
FIG. 13 is an exploded perspective view of a guide fan to which a blower fan module is coupled and a condenser in which a gasket foam is disposed.
Figure 14:
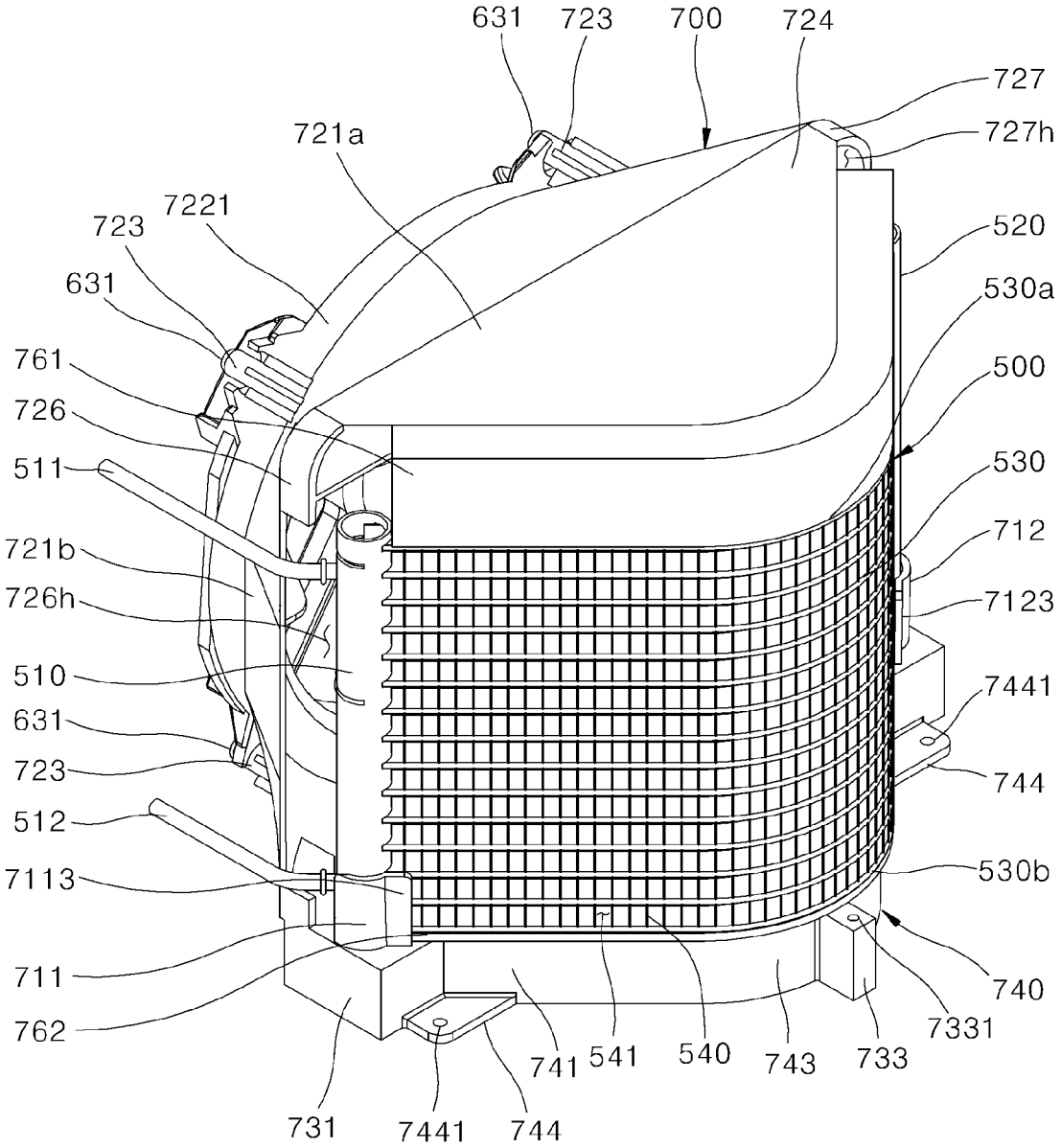
FIG. 14 is a perspective view showing a condenser in which a gasket foam is disposed is coupled to a guide fan.

Referring to FIGS. 13 and 14, the first header 510 and the second header 520 of the condenser 500 may be coupled to the first holder 711 and the second holder 712 of the guide fan 700 in the up-down direction, respectively.

In this case, the first gasket foam 761 may be disposed along an upper surface of the uppermost tube 530*a* provided at an uppermost position among the plurality of tubes 530.

The first gasket foam 761 may have a predetermined height and thickness to contact an outer circumferential portion of the upper surface extension 724.

In addition, a second gasket foam 762 may be disposed along a lower surface of a lowermost tube 530*b* positioned at the lowermost position among the plurality of tubes 530.

The second gasket foam 762 may have a predetermined height and thickness to contact an upper surface of the lower wall 740.

Since the first gasket foam 761 and the second gasket foam 762 are formed at the uppermost one and the lowermost one of the tube 530, respectively, the external air bypassed to the upper and lower portions of the condenser 500 without passing between the plurality of tubes 530 of the condenser 500 may be reduced.

Figure 15:
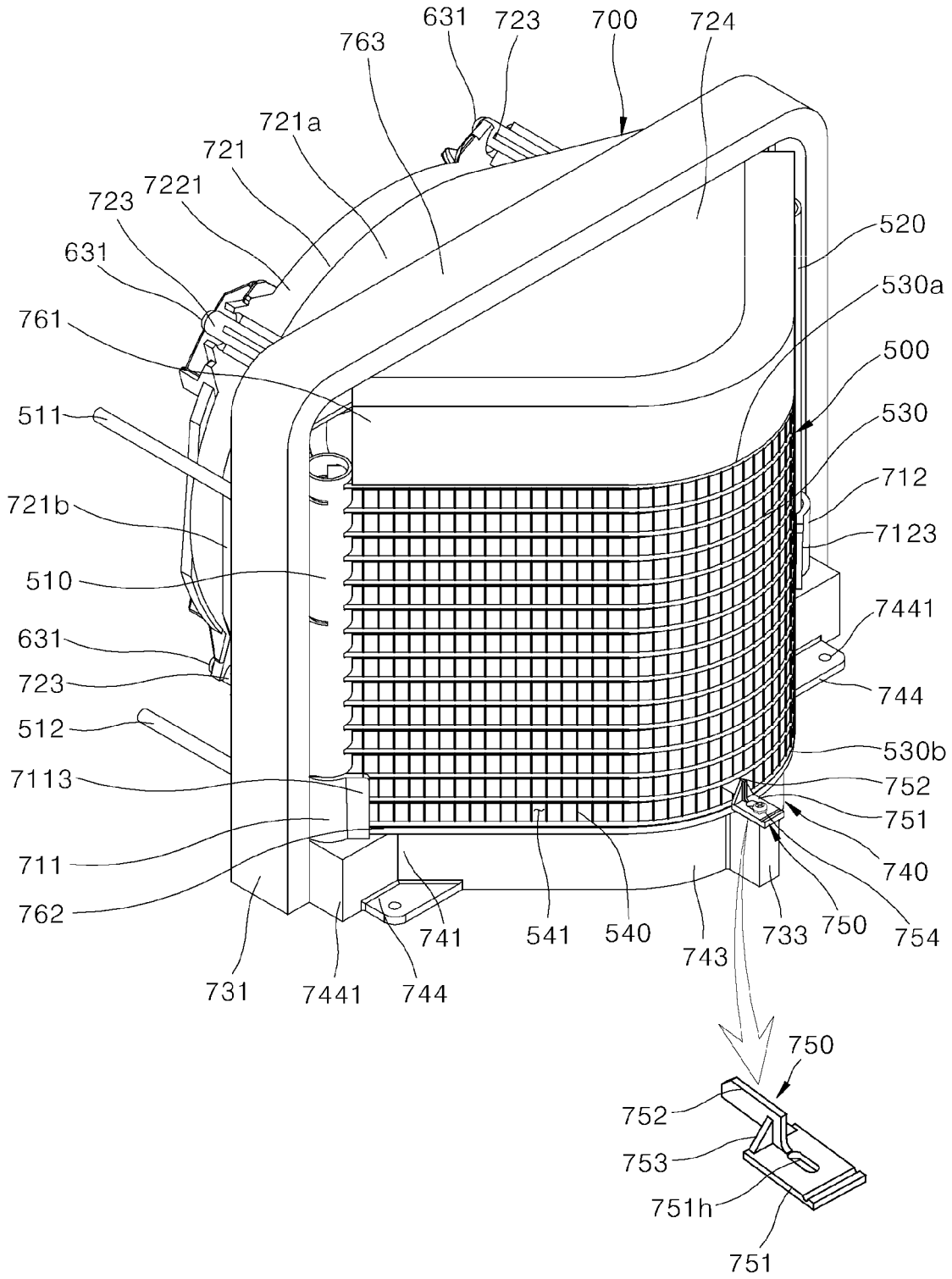
FIG. 15 is a perspective of a guide fan unit in which a gasket foam is additionally disposed along a rim including an upper surface of a guide fan.
Figure 16:
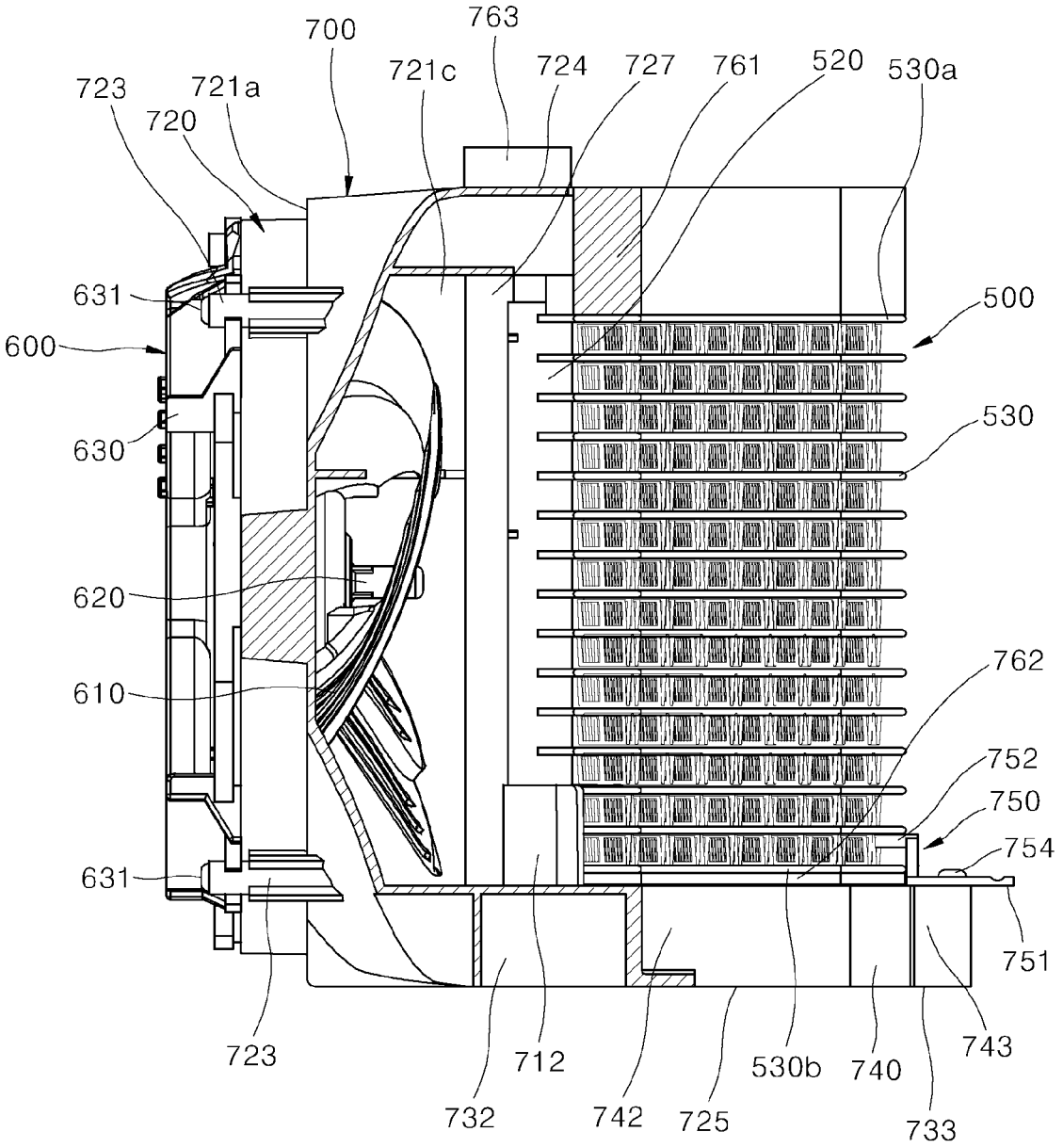
FIG. 16 is a sectional view of a guide fan unit according to an embodiment in which a gasket foam is additionally disposed along a circumference including an upper surface of a guide fan.

Referring to FIGS. 15 and 16, a third gasket may be disposed to surround both lateral surfaces of the guide fan 700 and the upper surface extension 724.

The third gasket foam 763 may cover a first space 726*h* between the first header 510 and the first lateral surface 726 of the guide fan 700 and a second space 727*h* between the second header 520 and the second lateral surface 727 of the guide fan 700.

In this case, that the third gasket foam 763 covers the first space 726*h* and the second space 727*h* is not limitedly understood as they completely seal the spaces, but it may be understood to include the formation of gaps in some area of the spaces.

Accordingly, the guide fan 700 according to the present disclosure may form the flow path guide shaped structure only with the structure of the guide fan 700 itself, but additionally dispose the gasket foams to provide the flow path guide shaped structure capable of further reducing the bypassed external air.

A fixing clip 750 may be additionally disposed to prevent the separation of the condenser 500 by additionally retraining the forward and backward movement and vertical movement of the condenser 500 from the guide fan 700 of the condenser 500.

The fixing clip 750 may include a coupling plate 751 in which a plate hole 751*h* is formed; and an inserting extension 752 bent and extended from one side of the coupling plate 751.

The coupling plate 751 may be a surface in contact with the third support portion 733, and may have a larger area than the upper surface of the third support portion 733 to provide stable support and fixing force.

In addition, for ease of work by an operator, the front-rear direction length of the coupling plate 751 may be longer than the front-rear direction length of the third support portion 733.

Accordingly, when the coupling plate 751 is coupled to the third support portion 733, some predetermined area of the coupling plate 751 may protrude outward from the third support portion 733.

In this case, a groove extending in the left-right direction may be formed in the protruded area of the coupling plate 751 from the outside of the third support portion 733, to further increase the ease of the work by the operator.

The plate hole 751*h* may be formed at a position corresponding to the coupling hole 7331 of the third support portion 733. The coupling member 754 such as a screw member may be coupled by passing through the plate hole 751*h* and the coupling hole 7331 to fix the coupling plate 751 to the upper surface of the third support portion 733.

In this case, the plate hole 751*h* may have a long opening in the front-rear direction, compared to the coupling hole 7331 of the third support portion 733, so that not only assembly tolerance can be considered but also various fixing structure according to possibility of design change of the condenser 500 can be prepared in advance.

The inserting extension 752 formed on one side of the fixing clip 750 may be inserted into a fin opening 541 formed between the plurality of tubes 530 and may press the fin opening 541 to press the tube disposed in the lower area downward.

In this instance, the inserting the inserting extension 752 may press the lowermost tube 530*b*, but the present disclosure is not limited thereto.

The inserting extension 752 may press the fin opening 541 to more strongly press the tube 530 downward, while the coupling plate 751 formed on the other side of the fixing clip 750 is coupled to the third support portion 733. Accordingly, the condenser 500 may be fixed to the guide fan 700 more strongly.

The inserting extension 752 may have a relatively narrow width in the left-right direction, compared to the up-down direction so as to be inserted into the fin opening 541.

In addition, the inserting extension 752 may extend longer than the front-back direction width of the fin opening 541 so as to be inserted into the fin opening 541 and may provide sufficient fixing force.

For example, the inserting extension 752 may have a hook shape, and may fix the tube 530 more strongly.

Considering a step between the coupling plate 751 and the fin opening 541 of the tube 530, a lower surface of the inserting extension may be formed higher than the coupling plate 751. In addition, a pair of reinforcing portions 753 supporting both lateral surfaces of the inserting extension 752 may be formed on the coupling plate 751, so that the strength of the inserting extension 752 having the relatively narrow width in the left-right direction may be reinforced.

In this case, the reinforcing portion 753 may be formed with a cross-sectional rear that increases from the top to the bottom, thereby providing stable strength reinforcement.

Figure 17:
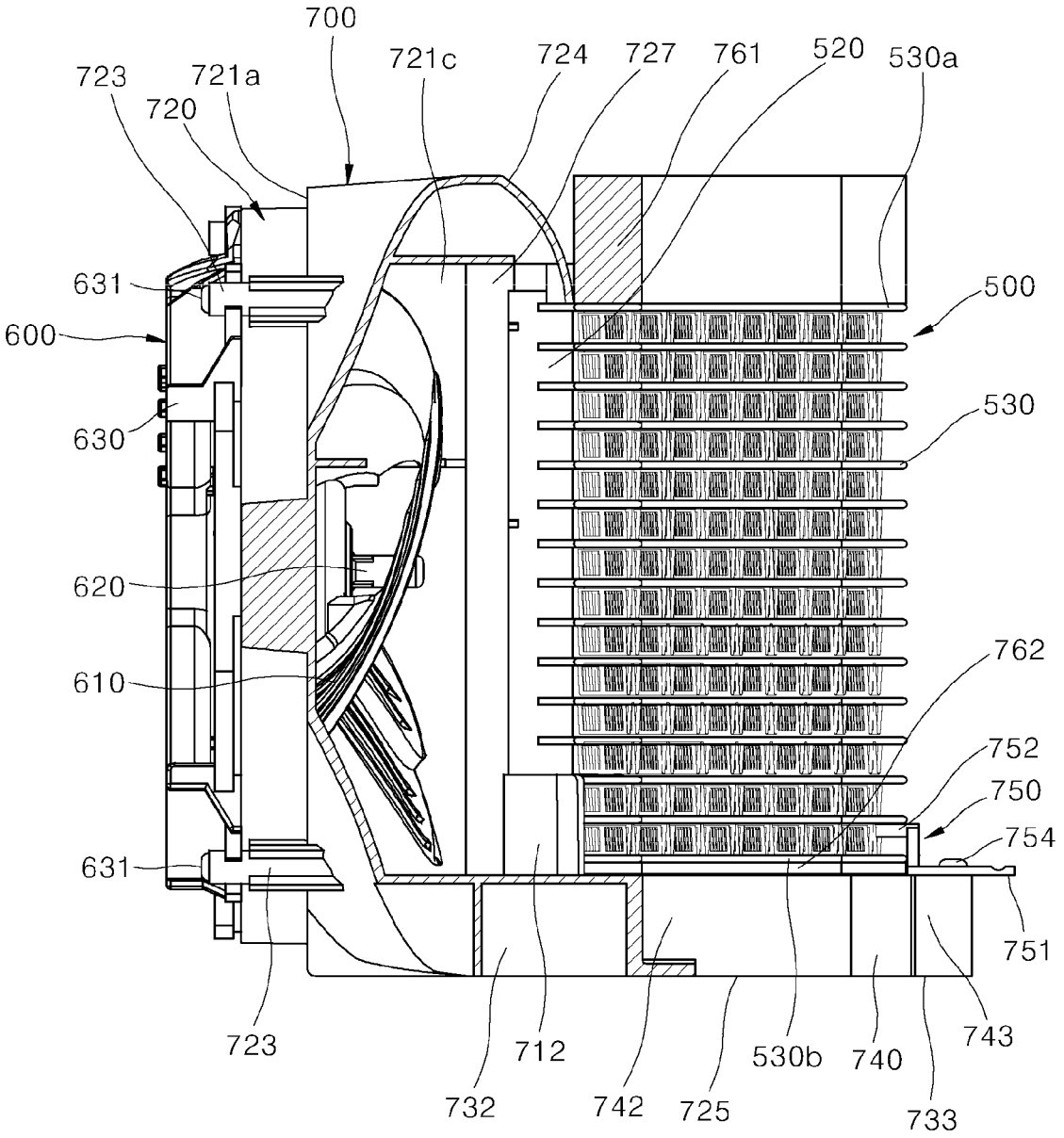
FIG. 17 is a sectional view of a guide fan unit showing another embodiment for a shape of an upper surface extension of a guide fan.

FIG. 17 is a sectional view of a guide fan unit 70 showing another embodiment for a shape of an upper surface extension of a guide fan 700.

As described above, the guide fan 700 according to the present disclosure may have the upper surface extension 724 extending from the upper end of the second mounting portion 720 of the guide fan 700 in the direction in which the condenser 500 is disposed, so that the flow path guide structure for eternal air passing through the condenser 500 may be formed only with the shape of the structure of the guide fan 700.

In this instance, the upper surface extension 724 may be formed to have a curved shape toward the condenser 500.

For example, an end of the upper surface extension 724 extending toward the condenser 500 may have a shape descending toward the condenser 500.

For example, one end of the upper surface extension 724 may extend toward the uppermost tube 530*a*.

In this instance, one end of the upper surface extension 724 may extend to contact the upper surface of the uppermost tube 530*a*.

Accordingly, the space between the condenser 500 and the upper surface extension 724 may be reduced as much as possible.

Since the space between the condenser 50 and the upper surface extension is reduced, air may flow upward to the top of the condenser 500 very well.

Accordingly, the external air introduced from the direction of the front surface of the guide fan unit 70 may pass through the condenser 500, without being bypassed upward the top of the condenser as much as possible.

In addition, the shape of the upper surface extension 724 is not limited to the shape descending toward the condenser 500, but it may be changed to a shape that allows air to flow well along the lower surface of the upper surface extension 724 without air leaking toward the upper surface extension 724 and the top of the condenser 500.

For example, the upper surface extension 724 may be formed to have a shape to be positioned adjacent as much as possible or in contact with the top of the condenser 500 to minimize the space between the upper surface extension 724 and the top of the condenser 500.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A refrigerator comprising:

a storage compartment; and a machine room comprising a first machine room and a second machine room located side by side in a left-right direction of the refrigerator;

a first condenser located in the first machine room;

a first compressor located in the first machine room;

a second condenser located in the second machine room;

a second compressor located in the second machine room; and an air inlet configured to introduce air into the machine room, wherein the first condenser is located in front of the first compressor, wherein the second condenser is located in front of the second compressor, wherein air introduced into the first machine room is discharged outside the refrigerator through a first circulation path, wherein air introduced into the second machine room is discharged outside the refrigerator through a second circulation path, wherein the first circulation path and the second circulation path have circulation directions that are opposite to each other, and wherein the air inlet, the first condenser, and the first compressor are aligned in a front back direction in the first air circulation path, and the air inlet, the second condenser, and the second compressor are aligned in a front back direction in the second air circulation path.

2. The refrigerator of claim 1, further comprising a grille cover located at a front surface of the machine room, the grille cover including a first air outlet and a second air outlet on opposite sides of the air inlet, the first air outlet and the second air outlet being configured to discharge the introduced air to the outside.

3. The refrigerator of claim 2, wherein the air inlet is located at a center area of the machine room at a boundary surface between the first machine room and the second machine room, wherein the first air outlet is located at a first lateral surface area of the machine room at an outer lateral surface of the first machine room, and wherein the second air outlet is located at a second lateral surface area of the machine room at an outer lateral surface of the second machine room.

4. The refrigerator of claim 3, wherein air circulating in the first circulation path is introduced through the air inlet and discharged through the first air outlet, and wherein air circulating in the second circulation path is introduced through the air inlet and discharged through the second air outlet.

5. The refrigerator of claim 2, further comprising a partition wall extending in a front-rear direction of the machine room to partition the machine room into the first machine room and the second machine room, wherein the first condenser and the first compressor are located adjacent to the partition wall, and wherein the second condenser and the second compressor are located adjacent to the partition wall.

6. The refrigerator of claim 5, wherein the grille cover further comprises:

a first partition portion extending between the air inlet and the first air outlet in a vertical direction; and a second partition portion extending between the air inlet and the second air outlet in the vertical direction.

7. The refrigerator of claim 6, further comprising:

a first front surface air guide located behind the first partition portion in the first machine room; and a second front surface air guide located behind the second partition portion in the second machine room, wherein the first partition portion extends rearward to the first front surface air guide, and wherein the second partition portion extends rearward to the second front surface air guide.

8. The refrigerator of claim 7, wherein the first front surface air guide and the second front surface air guide have flat surfaces extending in the front-rear direction.

9. The refrigerator of claim 7, wherein the first condenser and the first compressor are located between the partition wall and the first front surface air guide, and wherein the second condenser and the second compressor are located between the partition wall and the second front surface air guide.

10. The refrigerator of claim 5, further comprising:

a first defrost water tray located behind the first air outlet, and a second defrost water tray located behind the second air outlet.

11. The refrigerator of claim 10, further comprising:

a first rear surface air guide having a curved portion facing the first condenser, the first rear surface air guide being located at a corner between an outer lateral surface of the first machine room and a rear surface of the first machine room, the first defrost water tray being located between the first rear surface air guide and the first compressor; and a second rear surface air guide having a planar surface extending in a front-rear direction in the second machine room, the second defrost water tray being located between the second rear surface air guide and the second condenser.

12. The refrigerator of claim 11, wherein in plan view, a distance between a lateral surface of the second defrost water tray and the second rear surface air guide is shorter than a distance between a lateral surface of the first defrost water tray and the first rear surface air guide.

13. The refrigerator of claim 11, wherein in plan view, an overlapping length of a lateral surface of the second defrost water tray and the second rear surface air guide is greater than an overlapping length of a lateral surface of the first defrost water tray and the first rear surface air guide.

14. The refrigerator of claim 2, further comprising at least one door to open and close the storage compartment, the at least one door being located in front of a front surface of the grille cover so as to cover at least a portion of the grille cover.

15. The refrigerator of claim 2, wherein the grille cover comprises a plurality of guide ribs extending in the left-right direction, the plurality of guide ribs being spaced apart from each other in a vertical direction, each of the plurality of guide ribs being inclined upward in a rearward direction.

16. The refrigerator of claim 1, wherein the storage compartment includes a freezer compartment and a refrigerator compartment, wherein the first machine room is in fluid communication with the freezer compartment, and wherein the second machine room is in fluid communication with the refrigerator compartment.

* * * * *